United States Patent [19]

Ishibashi

[11] 4,426,904

[45] Jan. 24, 1984

[54] ENVELOPE CONTROL FOR ELECTRONIC MUSICAL INSTRUMENT

[75] Inventor: Masanori Ishibashi, Ome, Japan

[73] Assignee: Casio Computer Co., Ltd., Tokyo, Japan

[21] Appl. No.: 455,871

[22] Filed: Jan. 5, 1983

Related U.S. Application Data

[63] Continuation of Ser. No. 287,691, Jul. 28, 1981, abandoned.

[30] Foreign Application Priority Data

| | | | |
|---|---|---|---|
| Aug. 1, 1980 | [JP] | Japan | 55-105952 |
| Aug. 6, 1980 | [JP] | Japan | 55-108676 |
| Aug. 6, 1980 | [JP] | Japan | 55-108677 |
| May 19, 1981 | [JP] | Japan | 56-74244 |

[51] Int. Cl.[3] ..... G10H 1/057; G10H 7/00

[52] U.S. Cl. ..... 84/1.26; 84/1.13

[58] Field of Search ..... 84/1.13, 1.26

[56] References Cited

U.S. PATENT DOCUMENTS

| | | | |
|---|---|---|---|
| 4,079,650 | 3/1978 | Deutsch et al. | 84/1.26 |
| 4,083,285 | 4/1978 | Chibana | 84/1.26 |
| 4,133,244 | 1/1979 | Hiyoshi et al. | 84/1.26 |
| 4,135,424 | 1/1979 | Okamoto | 84/1.13 |
| 4,185,529 | 1/1980 | Kitagawa | 84/1.26 X |
| 4,205,577 | 6/1980 | Deutsch | 84/1.26 X |
| 4,214,503 | 7/1980 | Deutsch | 84/1.26 X |
| 4,267,763 | 5/1981 | Futamase et al. . | |
| 4,332,183 | 6/1982 | Deutsch | 84/1.26 |

FOREIGN PATENT DOCUMENTS

| | | |
|---|---|---|
| 24108 | 2/1981 | European Pat. Off. . |
| 2708006 | 9/1977 | Fed. Rep. of Germany . |
| 2021342 | 11/1979 | United Kingdom . |
| 2029072 | 3/1980 | United Kingdom . |
| 1567978 | 5/1980 | United Kingdom . |

*Primary Examiner*—S. J. Witkowski

*Attorney, Agent, or Firm*—Frishauf, Holtz, Goodman and Woodward

[57] ABSTRACT

Waveform data for converting attack, decay and release status sections of a musical sound envelope into an exponential function waveform is obtained from an envelope generator wherein exponential function waveform data is read out from a ROM or obtained through calculation based upon an exponential function in a digital logic processing circuit, and it is used for the envelope control of a tone signal from a digital wave generator.

14 Claims, 35 Drawing Figures

| SYMBOL | LOGIC EQUATION | GENERAL SYMBOL |
|---|---|---|
|  | c=a+b |  |
|  | c=a · b |  |
|  | |  |

| SYMBOL | LOGIC EQUATION |
|---|---|
|  | e = a + b + c<br>d = c |
|  | e = a · b · c<br>d = c |

| | | 128 | 64 | 32 | 16 | 8 | 4 | 2 | 1 |
|---|---|---|---|---|---|---|---|---|---|
| INPUT | 128 | 1 | 0 | 0 | 0 | 0 | 0 | 0 | 0 |
| OUTPUT | 112 | 0 | 1 | 1 | 1 | 0 | 0 | 0 | 0 |
| | 98 | 0 | 1 | 1 | 0 | 0 | 0 | 1 | 0 |
| | 85 | 0 | 1 | 0 | 1 | 0 | 1 | 0 | 1 |
| | 75 | 0 | 1 | 0 | 0 | 1 | 0 | 1 | 1 |
| | 65 | 0 | 1 | 0 | 0 | 0 | 0 | 0 | 1 |
| | 57 | 0 | 0 | 1 | 1 | 1 | 0 | 0 | 1 |
| | 50 | 0 | 0 | 1 | 1 | 0 | 0 | 1 | 0 |
| | 43 | 0 | 0 | 1 | 0 | 1 | 0 | 1 | 1 |
| | 38 | 0 | 0 | 1 | 0 | 0 | 1 | 1 | 0 |
| | 33 | 0 | 0 | 1 | 0 | 0 | 0 | 0 | 1 |
| | 29 | 0 | 0 | 0 | 1 | 1 | 1 | 0 | 1 |
| | 25 | 0 | 0 | 0 | 1 | 1 | 0 | 0 | 1 |
| | 22 | 0 | 0 | 0 | 1 | 0 | 1 | 1 | 0 |
| | 19 | 0 | 0 | 0 | 1 | 0 | 0 | 1 | 1 |
| | 17 | 0 | 0 | 0 | 1 | 0 | 0 | 0 | 1 |
| | 15 | 0 | 0 | 0 | 0 | 1 | 1 | 1 | 1 |
| | 13 | 0 | 0 | 0 | 0 | 1 | 1 | 0 | 1 |
| | 11 | 0 | 0 | 0 | 0 | 1 | 0 | 1 | 0 |
| | 10 | 0 | 0 | 0 | 0 | 1 | 0 | 1 | 0 |
| | 8 | 0 | 0 | 0 | 0 | 1 | 0 | 0 | 0 |

FIG. 9

| | | 128 | 64 | 32 | 16 | 8 | 4 | 2 | 1 |
|---|---|---|---|---|---|---|---|---|---|
| INPUT | 128 | 1 | 0 | 0 | 0 | 0 | 0 | 0 | 0 |
| | 120 | 0 | 1 | 1 | 1 | 1 | 0 | 0 | 0 |
| | 112 | 0 | 1 | 1 | 1 | 0 | 0 | 0 | 0 |
| | 105 | 0 | 1 | 1 | 0 | 1 | 0 | 0 | 1 |
| | 98 | 0 | 1 | 1 | 0 | 0 | 0 | 1 | 0 |
| | 92 | 0 | 1 | 0 | 1 | 1 | 1 | 0 | 0 |
| | 86 | 0 | 1 | 0 | 1 | 0 | 1 | 1 | 0 |
| | 81 | 0 | 1 | 0 | 1 | 0 | 0 | 0 | 0 |
| | 76 | 0 | 1 | 0 | 0 | 1 | 1 | 0 | 0 |
| | 71 | 0 | 1 | 0 | 0 | 0 | 1 | 1 | 1 |
| | 67 | 0 | 1 | 0 | 0 | 0 | 0 | 1 | 1 |
| | 62 | 0 | 0 | 1 | 1 | 1 | 1 | 1 | 0 |
| | 59 | 0 | 0 | 1 | 1 | 1 | 0 | 1 | 1 |
| | 55 | 0 | 0 | 1 | 1 | 0 | 1 | 1 | 1 |
| OUTPUT | 51 | 0 | 0 | 1 | 1 | 0 | 0 | 1 | 1 |
| | 48 | 0 | 0 | 1 | 1 | 0 | 0 | 0 | 0 |
| | 45 | 0 | 0 | 1 | 0 | 1 | 1 | 0 | 1 |
| | 42 | 0 | 0 | 1 | 0 | 1 | 0 | 1 | 0 |
| | 40 | 0 | 0 | 1 | 0 | 1 | 0 | 0 | 0 |
| | 37 | 0 | 0 | 1 | 0 | 0 | 1 | 0 | 1 |
| | 35 | 0 | 0 | 1 | 0 | 0 | 0 | 1 | 1 |
| | 33 | 0 | 0 | 1 | 0 | 0 | 0 | 0 | 1 |
| | 30 | 0 | 0 | 0 | 1 | 1 | 1 | 1 | 0 |
| | 29 | 0 | 0 | 0 | 1 | 1 | 1 | 0 | 1 |
| | 27 | 0 | 0 | 0 | 1 | 1 | 0 | 1 | 1 |
| | 25 | 0 | 0 | 0 | 1 | 1 | 0 | 0 | 0 |
| | ⋮ | | | | ⋮ | | | | |

FIG. 13

| | CALCULATION REG 30 | ADD/SUB 22 OUTPUT | ENVELOPE DATA | ENVELOPE OUTPUT |
|---|---|---|---|---|
| INPUT | 383 | 233 | 22 | 1 |
| | 360 | 211 | 44 | 2 |
| | 338 | 190 | 65 | 4 |
| | 317 | 171 | 84 | 5 |
| | 298 | 153 | 102 | 6 |
| | 280 | 136 | 119 | 7 |
| | 263 | 120 | 135 | 8 |
| | 247 | 105 | 150 | 9 |
| | 232 | 91 | 164 | 10 |
| | 218 | 78 | 177 | 11 |
| | 205 | 66 | 189 | 11 |
| | 193 | 54 | 201 | 12 |
| | 181 | 43 | 212 | 13 |
| | 170 | 33 | 222 | 13 |
| | 160 | 23 | 232 | 14 |
| | 150 | 14 | 241 | 15 |
| | 141 | 6 | 249 | 15 |
| | 133 | BORROW | 255 | 15 |

FIG. 14

| | CALCULATION REG 30 | ADD / SUB 22 INPUT | ENVELOPE DATA | ENVELOPE OUTPUT |
|---|---|---|---|---|
| INPUT | 55 | 52 | 252 | 15 |
| | 52 | 49 | 249 | 15 |
| | 49 | 46 | 246 | 15 |
| | 46 | 44 | 244 | 15 |
| | 44 | 42 | 242 | 15 |
| | 42 | 40 | 240 | 15 |
| | 40 | 38 | 238 | 14 |
| | 38 | 36 | 236 | 14 |
| | 36 | 34 | 234 | 14 |
| | 34 | 32 | 232 | 14 |
| | 32 | 30 | 230 | 14 |
| | 30 | 29 | 229 | 14 |
| | 29 | 28 | 228 | 14 |
| | 28 | 27 | 227 | 14 |
| | 27 | 26 | 226 | 14 |
| | 26 | 25 | 225 | 14 |
| | 25 | 24 | 224 | 14 |
| | 24 | 23 | 223 | 13 |
| | 23 | 22 | 222 | 13 |
| | 22 | 21 | 221 | 13 |
| | 21 | 20 | 220 | 13 |
| | 20 | 19 | 219 | 13 |
| | 19 | 18 | 218 | 13 |
| | 18 | 17 | 217 | 13 |
| | 17 | 16 | 216 | 13 |
| | 16 | 15 | 215 | 13 |
| | 15 | 15 | 215 | 13 |

FIG. 15A

| ENVELOPE DATA | ENVELOPE OUTPUT |
|---|---|
| INPUT 215 | 13 |
| 202 | 12 |
| 190 | 11 |
| 179 | 11 |
| 168 | 10 |
| 158 | 9 |
| 149 | 9 |
| 140 | 8 |
| 132 | 8 |
| 124 | 7 |
| 117 | 7 |
| 110 | 6 |
| 104 | 6 |
| 98 | 6 |
| 92 | 5 |
| 87 | 5 |
| 82 | 5 |
| 77 | 4 |
| 73 | 4 |
| 69 | 4 |
| 65 | 4 |
| 61 | 3 |
| 58 | 3 |
| 55 | 3 |
| 52 | 3 |
| 49 | 3 |

FIG. 15B

| ENVELOPE DATA | ENVELOPE OUTPUT |
|---|---|
| 46 | 2 |
| 44 | 2 |
| 42 | 2 |
| 40 | 2 |
| 38 | 2 |
| 36 | 2 |
| 34 | 2 |
| 32 | 2 |
| 30 | 1 |
| 29 | 1 |
| 28 | 1 |
| 27 | 1 |
| 26 | 1 |
| 25 | 1 |
| 24 | 1 |
| 23 | 1 |
| 22 | 1 |
| 21 | 1 |
| 20 | 1 |
| 19 | 1 |
| 18 | 1 |
| 17 | 1 |
| 16 | 1 |
| 15 | 0 |
| 0 | 0 |

FIG. 20

| | | | | | | | | | |
|---|---|---|---|---|---|---|---|---|---|
| 0 | 1 | 3 | 4 | 6 | 7 | 9 | 10 | 12 | 13 |
| 15 | 16 | 17 | 19 | 20 | 22 | 23 | 25 | 26 | 27 |
| 29 | 30 | 32 | 33 | 35 | 36 | 37 | 39 | 40 | 41 |
| 43 | 44 | 46 | 47 | 48 | 50 | 51 | 52 | 53 | 55 |
| 56 | 57 | 59 | 60 | 61 | 63 | 64 | 65 | 66 | 68 |
| 69 | 70 | 71 | 73 | 74 | 75 | 76 | 78 | 79 | 80 |
| 81 | 82 | 84 | 85 | 86 | 87 | 88 | 90 | 91 | 92 |
| 93 | 94 | 96 | 97 | 98 | 99 | 100 | 101 | 102 | 103 |
| 105 | 106 | 107 | 108 | 109 | 110 | 111 | 112 | 113 | 114 |
| 116 | 117 | 118 | 119 | 120 | 121 | 122 | 123 | 124 | 125 |
| 126 | 127 | 128 | 129 | 130 | 131 | 132 | 133 | 134 | 135 |
| 136 | 137 | 138 | 139 | 140 | 141 | 142 | 143 | 144 | 145 |
| 146 | 147 | 148 | 149 | 150 | 151 | 152 | 153 | 154 | 154 |
| 155 | 156 | 157 | 158 | 159 | 160 | 161 | 162 | 163 | 164 |
| 164 | 165 | 166 | 167 | 168 | 169 | 170 | 171 | 171 | 172 |
| 173 | 174 | 175 | 176 | 177 | 177 | 178 | 179 | 180 | 181 |
| 181 | 182 | 183 | 184 | 185 | 185 | 186 | 187 | 188 | 188 |
| 190 | 190 | 191 | 192 | 193 | 193 | 194 | 195 | 196 | 196 |
| 197 | 198 | 199 | 199 | 200 | 201 | 202 | 202 | 203 | 204 |
| 205 | 205 | 206 | 207 | 208 | 208 | 209 | 210 | 210 | 211 |
| 212 | 212 | 213 | 214 | 214 | 215 | 216 | 217 | 217 | 218 |
| 219 | 219 | 220 | 221 | 221 | 222 | 223 | 223 | 224 | 225 |
| 225 | 226 | 226 | 227 | 228 | 228 | 229 | 230 | 230 | 231 |
| 231 | 232 | 233 | 233 | 234 | 235 | 235 | 236 | 236 | 237 |
| 238 | 238 | 239 | 240 | 240 | 241 | 241 | 242 | 242 | 243 |
| 243 | 244 | 245 | 245 | 246 | 246 | 247 | 247 | 248 | 249 |
| 249 | 250 | 250 | 251 | 251 | 252 | 252 | 253 | 254 | 254 |
| 255 | | | | | | | | | |

FIG. 21

| | | | | | | | | | |
|---|---|---|---|---|---|---|---|---|---|
| 255 | 250 | 247 | 241 | 236 | 232 | 228 | 224 | 220 | 217 |
| 213 | 210 | 207 | 203 | 201 | 198 | 195 | 192 | 190 | 187 |
| 185 | 183 | 181 | 178 | 176 | 174 | 173 | 171 | 169 | 167 |
| 166 | 164 | 163 | 162 | 160 | 159 | 157 | 156 | 155 | 154 |
| 153 | 152 | 151 | 150 | 149 | 148 | 147 | 146 | 146 | 145 |
| 144 | 144 | 143 | 142 | 142 | 141 | 140 | 140 | 139 | 139 |
| 138 | 138 | 137 | 137 | 137 | 136 | 136 | 135 | 135 | 135 |
| 134 | 134 | 133 | 133 | 133 | 133 | 133 | 133 | 132 | 132 |
| 132 | 131 | 131 | 131 | 131 | 131 | 130 | 130 | 130 | 130 |
| 130 | 130 | 130 | 129 | 129 | 129 | 129 | 129 | 129 | 129 |
| 129 | 128 | 128 | 128 | 128 | 128 | 128 | 128 | 128 | 128 |
| 128 | 128 | 128 | 128 | 127 | 127 | 127 | 127 | 127 | 127 |
| 127 | 127 | 127 | 127 | 127 | 127 | 127 | 127 | 127 | 127 |
| 127 | 127 | 127 | 127 | 127 | 127 | 127 | 127 | 127 | 127 |
| 127 | 127 | 126 | | | | | | | |

FIG. 22

| | | | | | | | | | |
|---|---|---|---|---|---|---|---|---|---|
| 126 | 121 | 117 | 112 | 107 | 104 | 100 | 96 | 92 | 89 |
| 85 | 82 | 78 | 76 | 73 | 70 | 67 | 65 | 62 | 60 |
| 58 | 55 | 53 | 51 | 49 | 47 | 46 | 44 | 42 | 40 |
| 39 | 37 | 36 | 35 | 33 | 32 | 31 | 30 | 28 | 27 |
| 26 | 25 | 24 | 23 | 23 | 22 | 21 | 20 | 19 | 19 |
| 18 | 17 | 16 | 16 | 15 | 15 | 14 | 14 | 13 | 13 |
| 12 | 12 | 11 | 11 | 10 | 10 | 10 | 9 | 9 | 8 |
| 8 | 8 | 8 | 7 | 7 | 7 | 6 | 6 | 6 | 6 |
| 6 | 5 | 5 | 5 | 5 | 5 | 4 | 4 | 4 | 4 |
| 4 | 4 | 3 | 3 | 3 | 3 | 3 | 3 | 3 | 3 |
| 3 | 2 | 2 | 2 | 2 | 2 | 2 | 2 | 2 | 2 |
| 2 | 2 | 2 | 2 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 0 | | | | | | | |

ENVELOPE CONTROL FOR ELECTRONIC MUSICAL INSTRUMENT

This is a continuation of application Ser. No. 287,691 filed July 28, 1981, and now abandoned.

BACKGROUND OF THE INVENTION

This invention relates to envelope controls used for electronic musical instruments such as music synthesizers for varying the musical sound envelope in the order of attack, decay, sustain and release status sections from the instant of depressing a key till an instant after the key is released.

The music synthesizer is usually provided with an envelope generator for converting the musical sound envelope into a desired form. The envelope control signal generated from such an envelope generator is used to control a voltage controlled oscillator (VCO), a voltage controlled filter (VCF) or a voltage controlled amplifier (VCA). Hitherto, an envelope generator which is constructed as an analog circuit has been constituted by a commonly termed CR charging/discharging circuit including a capacitor and a resistor. The capacitance of the capacitor and the resistance of the resistor are subject to changes in long use, and the changes of these circuit parameters result in changes of the characteristics of the envelope that is generated. In addition, since the CR charging/discharging circuit is constructed by using discrete capacitive and resistive elements, the envelope generator has a large size. Especially, in the case of a composite musical sound synthesizer with which various envelopes can be provided for a single musical tone with the operation of a select switch, envelope generators corresponding in number to the number of envelopes to be provided are required, thus leading to a very large size construction.

SUMMARY OF THE INVENTION

An object of the invention is to provide an envelope control for electronic musical instrument, which is free from changes of circuit parameters in long use, can generate stable envelope control signal and permits a number of envelopes to be provided with a small-size construction.

According to the invention, the above object is attained by an envelope control for electronic musical instrument, which has an envelope generator of an entirely digital circuit construction to provide an envelope having an exponential function waveform simulating the human sense-of-hearing curve.

BRIEF DESCRIPTION OF THE DRAWINGS

FIG. 9 is a view showing digital values of the envelope output obtained from the envelope generator shown in FIG. 8 when a constant $\alpha$ is $\alpha=16$;

FIG. 13 is a view showing calculations performed by the envelope generator of FIG. 12 when forming the attack status section of an envelope;

FIG. 14 is a view showing calculations performed by the envelope generator of FIG. 12 when forming the decay and sustain status section of envelope;

FIGS. 15A and 15B are views showing calculations performed when forming the release status section of envelope;

FIGS. 20 to 22 are views showing changes of the envelope output during the attack, decay and release periods respectively;

DETAILED DESCRIPTION OF THE PREFERRED EMBODIMENTS

Figure 1:
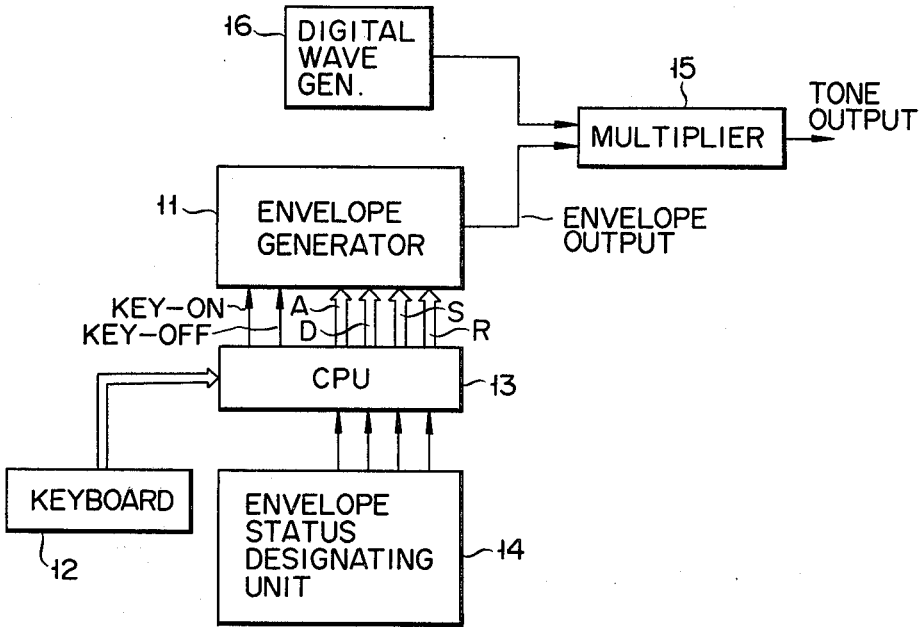
FIG. 1 is a block diagram showing an embodiment of the invention.
Figure 2:
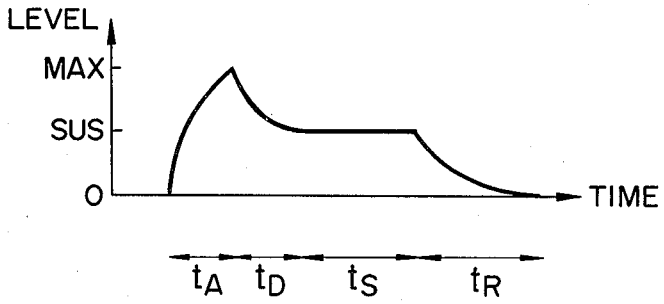
FIG. 2 is a graph showing a typical envelope generated from an envelope generator employed in one embodiment of the invention.

Referring now to FIG. 1, there is shown a composite musical sound synthesizer comprising an envelope generator 11, to which key-on and key-off signals from a keyboard 12 are coupled through a central processing unit (CPU) 13. To the CPU 13 are also supplied attack, decay sustain and release data from an envelope status designating unit 14. This unit 14 may be constituted by, for instance, a switch group provided on an operation panel of the synthesizer such that the individual data, i.e., data for the attack, decay and release periods and sustain level, can be set to desired values by operating respective switch levers. In the CPU 13, the switch output is adjusted to be timed to a key operation signal from the keyboard 12, and is supplied from the CPU 13 as attack data A, decay data D, sustain data S and release data R (for instant each of 4 bits) together with key-on and key-off signals to the envelope generator 11. The envelope generator 11 provides an envelope output as shown in FIG. 2, which appears in an attack status from the instant of operation of a key or key-on instant to eventually undergo transition to a decay status and then to a sustain status and is changed a release status at the instant when the key is released or key-off instant. This envelope output is supplied to one of two input ends of a multiplier 15. In FIG. 2, labeled $t_A$, $t_D$, $t_S$ and $t_R$ are respectively the attack, decay, sustain and release periods labeled MAX is the maximum level of the envelope, and labeled SUS is the sustain level. A tone wave signal is supplied from a digital wave generator 16 to the other input end of the multiplier 15, in which an envelope of the tone wave signal is formed in accordance with the envelope output of the envelope generator 11, and from which a tone output having a desired ADSR envelope is obtained.

Figure 5A:
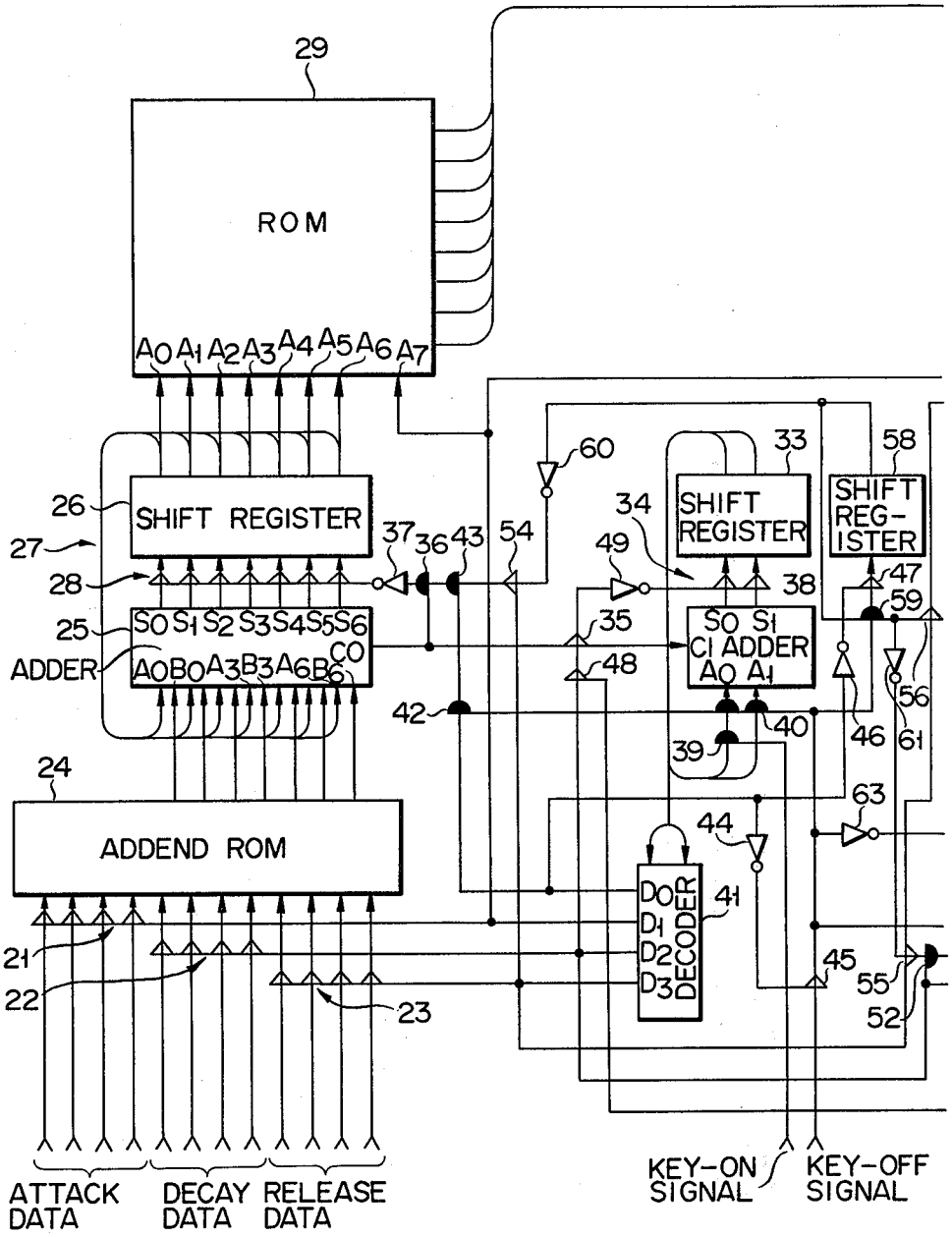
FIGS. 5A and 5B are schematics showing the envelope generator shown in FIGS. 4A and 4B.
Figure 5B:
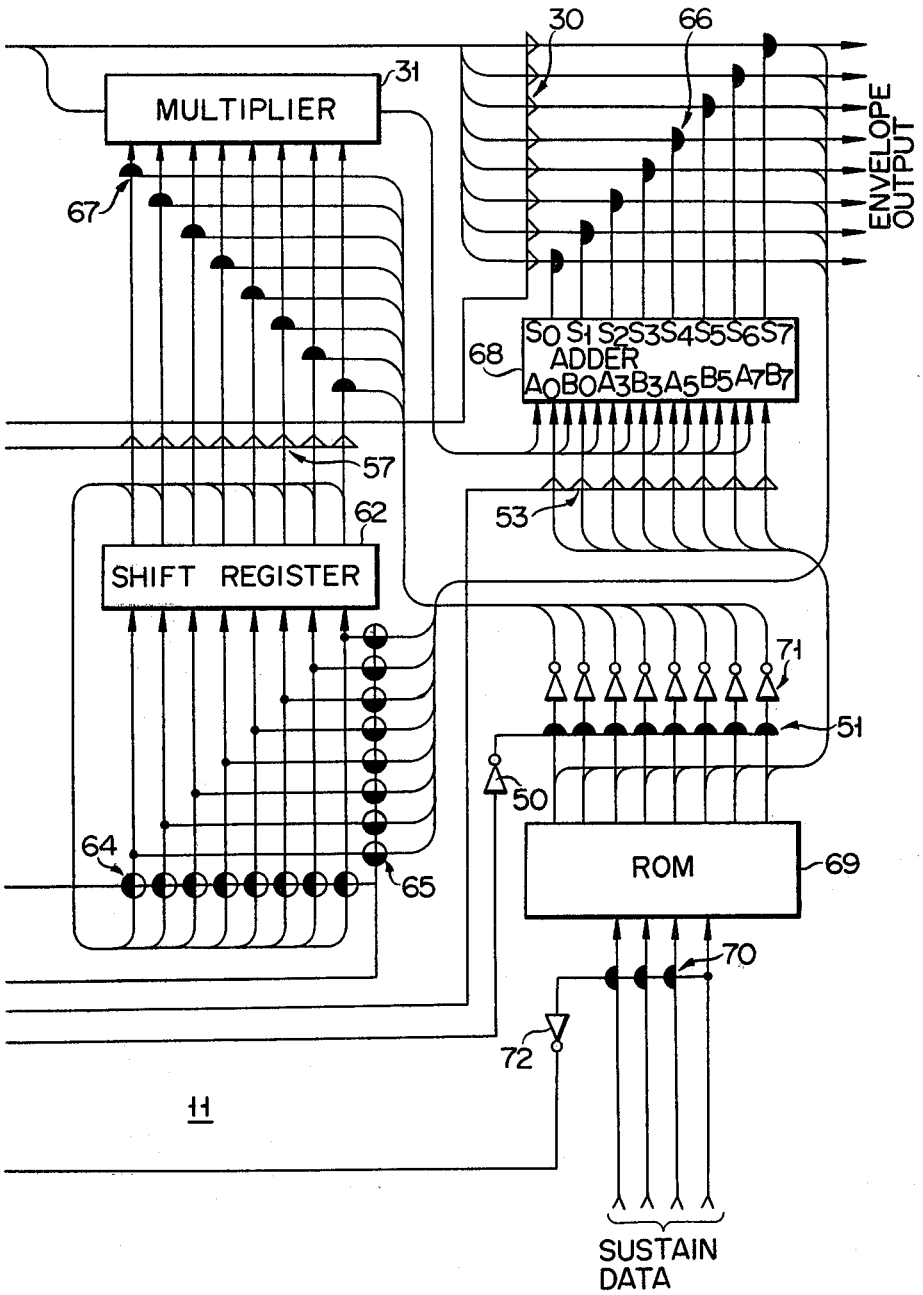

The attack, decay, sustain and release status sections of the envelope can be set to desired values by switches in the unit 14 for the corresponding attack period $t_A$, decay period $t_D$, sustain level SUS and release period $t_R$, as shown in FIGS. 3A to 3D, and an envelope consisting of a desired combination of the envelope sections shown in FIGS. 3A to 3D can be formed through the circuit shown in FIGS. 1, 5A and 5B.

Figure 3A:
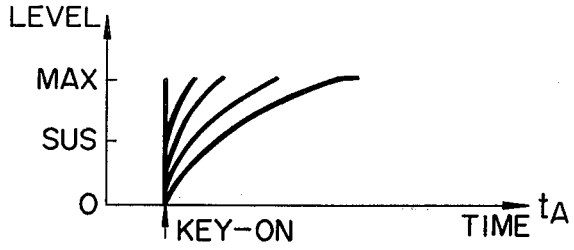
FIGS. 3A to 3D are graphs showing the changes of attack, decay, sustain and release status sections of the envelope respectively.
Figure 3B:
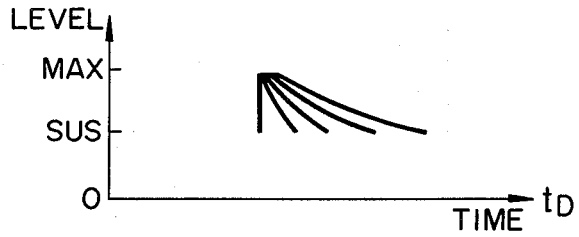
Figure 3C:
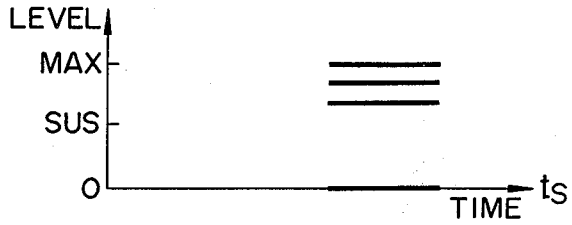
Figure 3D:
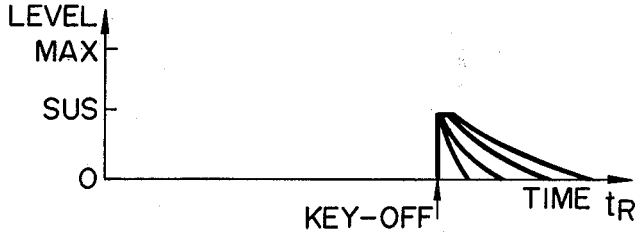

In FIG. 3A, the abscissa is taken for the attack period $t_A$, i.e., the period until the amplitude of the envelope reaches the maximum level MAX from the key-on instant, at which time the envelope level is zero. In FIG. 3B, the abscissa is taken for the decay period $t_D$, i.e., the period from the end of the attack period or the instant of the aforementioned maximum level MAX till the reaching of the sustain level SUS. FIG. 3C shows the sustain level SUS, i.e., a constant level sustained while the key is "on" after the attack and decay periods (the sustain level SUS being preset by a sustain lever to a desired level in a range from zero level to the maximum level MAX). In FIG. 3D, the abscissa is taken for the release period $t_R$, i.e., the period from the key-off instant till the reaching of zero level. The release of a key or key-off may be made either in the attack, decay or sustain status.

Figure 4A:
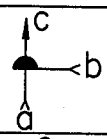
FIGS. 4A and 4B are views showing one-to-one correspondence between symbols of circuit elements and logic equations discussed in the specification.
Figure 4A:
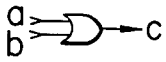
Figure 4A:
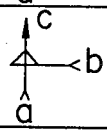
Figure 4A:
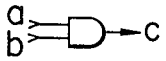
Figure 4A:
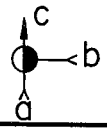
Figure 4A:
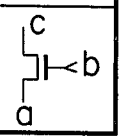
Figure 4B:
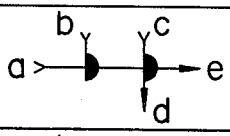
Figure 4B:
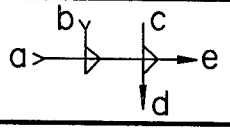

FIG. 4A shows the relationships among the symbols used in FIGS. 5A and 5B and corresponding logic equations and general notations. In the Figure, the relations are shown for the OR gate, AND gate and switching gate. FIG. 4B shows examples of application of the symbols shown in FIG. 4A in case where there are three input signals a, b and c. There is a feature in the relation between an input signal c and an output signal d here.

Now, the circuit construction of the envelope generator 11 shown in FIG. 1 will be described with reference to FIGS. 5A and 5B. The attack period $t_A$, decay period $t_D$ and release period $t_R$ which are respectively set by an attack lever, a decay lever and a release lever, are fed as respective attack data, decay data and release data each consisting of four bits from the CPU 13 to the envelope generator 11. The attack, decay and release data thus provided are coupled through respective AND gate groups 21 to 23 to a read only memory (ROM) 24, which provides an increment data (7-bit data) for incrementing an envelope counter 27 which includes an adder 25 and a shift register 26 at the time of the receipt of the attack data, decay data and release data mentioned above. Thus, the counting speed of the envelope counter 27 is controlled according to the value of the increment data and the output timing thereof.

The output data (7-bit data) of the shift register 26 is coupled to input terminals $A_0$ to $A_6$ of the adder 25, while increment data from the ROM 24 is coupled to other input terminals $B_0$ to $B_6$ of the adder. In the adder 25, both the input data are added, and the resultant addition data (7-bit data) is supplied through an AND gate group 28 to the shift register 26. The output data of the shift register 26 is coupled as address data to address input terminals $A_0$ to $A_6$ of a ROM 29. The shift register 26 includes eight registers each having a capacity of seven bits and connected in cascade. This construction constitutes an envelope generator for eight channels (first to eighth channels); that is, even in case when the maximum of eight keys are simultaneously turned on, it can form the envelopes for the respective turned-on keys through a time-division-basis multiple processing. All the other shift registers in FIGS. 5A and 5B also have an 8-channel register construction.

The ROM 29 has a capacity of, for instance, 256×8 bits, and waveform data of the attack status (data of waveform, the amplitude of which increases as an exponential function like a charging curve) are stored in an area constituted by bits of addresses "128" to "255" and decay and release status waveform data (data of a waveform, the amplitude of which decreases as an exponential function like a discharging curve) in an areas constituted by bits of addresses "0" to "127". The switching of the area of the addresses "0" to "127" and the area of the addresses "128" to "255" is effected according to a one-bit input data to an address input terminal $A_7$ (to be described later). The waveform data (8-bit data) read out from the individual addresses of the ROM 29 is coupled to an AND gate group 30 and also to a multiplier 31.

An adder 32 and a shift register 33 constitute an envelope status counter 34. When the content (or count) of a certain register in the shift register 33 is "0", it indicates that the relevant channel is a vacant channel where no envelope is being formed. When the content is "1", it indicates that the attack status section (attack period) of envelope is being formed for that channel, when it is "2" it indicates that the decay status section (decay period) is being formed, and when it is "3" it indicates that the sustain status section (sustain period) or release section (release period) is being formed. The adder 32 has input terminals $A_0$ and $A_1$, to which the output data of the shift register (constituted by eight 2-bit registers connected in cascade) 33 is coupled, and a carry input terminal CI, to which a carry signal from a carry output terminal CO of the adder 25 is coupled. Thus, when the adder 32 receives a carry signal, it adds a data "+1" to the data from the shift register 33 to cause the switching of the envelope status to the next one. The aforementioned carry signal is also coupled through an inverter 37 to the AND gate group 28 mentioned above for controlling these gates.

The adder 32 supplies 2-bit addition data from its output terminals $S_0$ and $S_1$ through an AND gate group 38 to the shift register 33. Of the output data from the shift register 33, the lower bit data is coupled through an OR gate 39, which also receives a key-on signal (which is a one-bit time pulse), and also through an OR gate group 40 to the input terminal $A_0$ of the adder 32,, while the upper bit data is coupled through the OR gate group 40, which also receives a key-off signal (which is a one-bit time pulse) to the input terminal $A_1$ of the adder 32. The output data from the shift register 33 is further coupled to a decoder 41 and decoded therein, whereby a signal of binary logic level "1" is provided from one of output terminals $D_0$ to $D_3$ depending upon the content of the decoded data, more particularly from the output terminal $D_0$ when the content is "0", from the terminal $D_1$ when the content is "1", from the terminal $D_2$ when the content is "2" and from the terminal $D_3$ when the content is "3". The output from the output terminal $D_0$ of the decoder 41 is coupled through OR gates 42 and 43 to the aforementioned OR gate 36, and it is also coupled as a gate control signal through an inverter 44 to an AND gate 45, which also receives the aforementioned key-off signal. It is further coupled as a gate control signal through an inverter to an AND gate 47. The output of the output terminal $D_1$ of the decoder 41 is used as a gate control signal for the AND gate groups 21 and 30 mentioned above, and is also coupled to the aforementioned address input terminal $A_7$ of the ROM 29. The output of the output terminal $D_2$ of the decoder 41 is coupled as a gate control signal to the AND gate group 22 mentioned above, and it is also coupled to an AND gate 48, and the output thereof is also coupled as a gate control signal through the aforementioned AND gate 35 and an inverter 49 to the AND gate group 38 mentioned above. It is further coupled as a gate control signal through an inverter 50 to an OR gate group 53. The output of the output terminal $D_3$ of the decoder 41 is coupled as a gate control signal to the AND gate group 23 mentioned above and also to AND gates 54 and 55, and it is also coupled as a gate control signal through an AND gate 56 to an AND gate group 57.

The shift register 58 includes eight one-bit registers connected in cascade. To the shift register 58, the output of the AND gate 47, which is controlled for gating by the output from the output terminal $D_0$ of the decoder 41 as mentioned earlier, is coupled, and also the key-off signal is coupled through the AND gate 45, OR gate 59 and AND gate 47 to the shift register 58. Further, the output of the shift register 58 is fed back through the OR gate 59 and AND gate 47 to itself. Thus, when a key is turned off, a signal "1" is written in the shift register 58, which corresponds to a channel for the turned-off key by the key-off signal therefrom, whereby the register for that channel is set. This set state is held until the end of the release section of the envelope for that key. Also, when the aforementioned channel becomes vacant with the end of the release section, thus rendering the relevant channel in the shift register 33 to be a vacant channel, the register for that channel in the shift register 58 is reset. In other words, with the shift register 33 provided, when the envelope status for a certain channel in the shift register 33 is "3", indicating that the sustain or release status of the envelope in that channel is in force, the distinction between the sustain and release can be obtained in terms of whether the corresponding channel in the shift register 58 is set or reset. The output of the shift register 58 is further coupled through an inverter 60 to the AND gate 54 and also through an inverter 61 to the AND gate 55.

A shift register 62, which includes eight 8-bit registers connected in cascade, operates such that when a certain key is turned off, the envelope value (envelope output value) for that key at the time of turning-off thereof is stored in the register for the relevant channel while starting the formation of the release status section of the envelope for that key from a preset envelope value. To this end, the key-off signal is coupled through the AND gate 45 and an inverter 63 to individual gates of a switching gate group 64. Also, it is coupled through the AND gate 45 to individual gates of a switching gate group 65. Further, the envelope output from an OR gate group 66 is coupled through the switching gate group 65 to the input terminals of the shift register 62, and the output thereof is fed back thereto through the switching gate group 64. Thus, when a certain key is released, a key-off signal thus provided therefrom disables the switching gate group 64, while the envelope output from the OR gate group 66, is coupled through the switching gate group 65, which is enabled by the key-off signal, whereby the envelope value at the key-off instant is set in the shift register 62. This envelope value is held circulated through a circulating circuit, which is constituted by the switching gate group 64 which is enabled after the vanishment of the key-off signal and the shift register 62, while it is also coupled through the AND gate group 57 and an OR gate group 67 to the multiplier 31.

After the release of the key, the multiplier 31 multiplies the waveform data read out from the ROM 29 and the envelope value from the shift register 62 and provides the resultant multiplied output (8-bit data) to input terminals $A_0$ to $A_7$ of an adder 68.

In a ROM 69, data (8-bit data) for providing various sustain levels are preset, and when sustain data (4-bit data) read out from the sustain level is supplied as address data to the ROM 69, the data of the sustain level of the magnitude corresponding to the value of the input sustain data is read out and coupled through an OR gate group 51, an inverter group 71 and the OR gate group 67 to the multiplier 31 and also through the AND gate group 53 to input terminals $B_0$ to $B_7$ of the adder 68.

When the formation of the decay status section of the envelope for a key is started, the output of the inverter 50 goes to "0", whereupon the sustain level data read out from the ROM 60 is supplied as inverted data through an inverter group 71 to the multiplier 31. The multiplier 31 multiplies the waveform data from the ROM 29 by the inverted data mentioned above and supplies the resultant data to the input terminals $A_0$ to $A_7$ of the adder 68. At this time, the sustain level data from the ROM 68 is directly supplied through the AND gate group 53, which is "on" at this time, to the input terminals $B_0$ to $B_7$ of the adder 68, and the adder 68 thus adds the multiplication result output mentioned above and the sustain level data and supplies the resultant addition output as the envelope output for the decay status section through its output terminals $S_0$ to $S_7$ and the OR gate group 66. On the other hand, at the time of the formation of the sustain status section of the envelope for a key, the aforementioned sustain level data is directly provided as the envelope output through the AND gate group 53, adder 68 and OR gate group 66. Further, at the time of the formation of the release status section of envelope, the aforementioned multiplication result output obtained from the waveform data from the ROM 29 and the envelope value from the shift register 62, provided from the multiplier 31, is provided as the envelope output through the adder 68 and OR gate group 66.

If it is arranged such that with zero sustain level that is provided as the aforementioned sustain level data, the relevant channel is rendered to be a vacant channel by resetting the envelope status counter 34 after the completion of formation of the attack and decay status sections of envelope, the assignment of channels to a key that will be operated next will be made more efficiently. Accordingly, the output of the OR gate group 70 is coupled as a gate signal through the inverter 72 to the AND gate 48. Since the AND gate 48 receives the output of the output terminal $D_2$ of the decode 41 as an input signal, with the appearance of a carry signal from the adder 25 at the time of the end of the decay period in a channel, that channel is forcibly cleared to become a vacant channel. Thus, even if the key, to which the channel having thus been forcibly rendered into a vacant channel is assigned, is continuously held "on" after the end of the decay status section, this "on" state of key can be made invalid, and the aforementioned channel rendered into a vacant channel can thus be made available as a vacant channel capable of being assigned to a key that may be subsequently operated.

The construction of the CPU 13, which controls the overall operation of the composite musical sound synthesizer of this embodiment including the operation of assigning channels to keys, does not constitute the subject matter of the invention and is not described.

Figure 6:
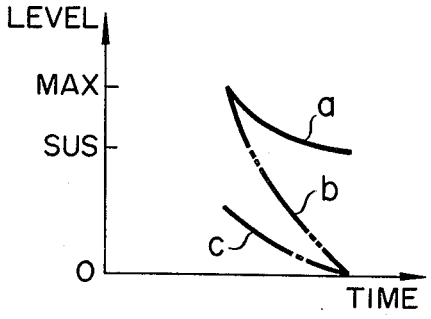
FIG. 6 is a waveform diagram showing how the decay status section of envelope is formed.
Figures 7, 10:
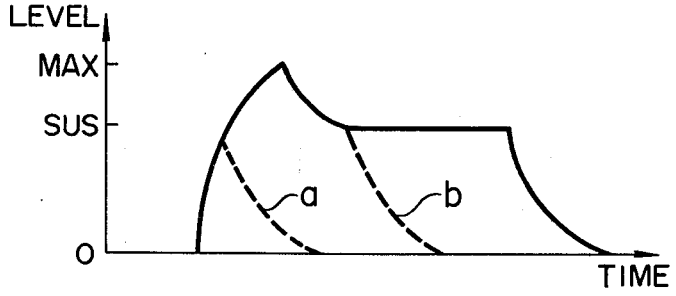
FIG. 7 is a waveform diagram showing changes of the envelope waveform at the time of turning off a key during the attack and decay periods.
FIG. 10 is a view showing digital values of the envelope output obtained from the envelope generator shown in FIG. 8 when a constant $\alpha$ is $\alpha=8$.

The operation of the embodiment described above will now be described with reference to FIGS. 6 and 7. It is assumed that the attack lever, decay lever, sustain lever and release lever are set to desired positions before the start of music performance with the synthesizer. Thus, desired attack, decay and release periods $t_A$, $t_D$ and $t_R$ can be coupled as attack, decay and release data to the ROM 24. Further, it is assumed that the sustain level is set to a level between zero level and the maximum level MAX, and thus this preset sustain level SUS can be coupled as sustain data to the ROM 69.

The operation in case when a certain channel is a vacant channel will be described first. In this case, the count of the envelope status counter 34 for the vacant channel mentioned above, that is, the content of the register for that vacant channel in the shift register 33, is "0". Thus, every time the content "0" for that vacant channel is provided from the shift register 33, a "1" signal is provided from the output terminal $D_0$ of the decoder 41. Since the "1" signal is coupled through the OR gates 42, 43 and 36 to the inverter 37, the output of the inverter 37 goes to "0" at this time, thus causing the output supplied from the AND gate group 28 to the shift register 26 to go to "0". Thus, the content of the register for the aforementioned vacant channel in the shift register 26 also goes to "0". This content of "0" is circulated through the circulating circuit constituted by the shift register 26, adder 25 and AND gate group 28. Also, every time the content of "0" is the vacant channel is provided from the shift register 26, it is supplied to the address input terminals $A_0$ to $A_6$ of the ROM 29, while a "0" signal is simultaneously supplied to the address input terminal $A_7$, so that the address "0" of the ROM 29 is always specified at the timing of the aforementioned vacant channel. Further the output signal of "1" from the output terminal $D_0$ of the decoder 41 is coupled through the inverter 46 to the AND gate 47 to enable the AND gate 47, and thus a "0" signal is always written in the shift register 58 at the timing for the vacant channel. Since the output of "1" from the output terminal $D_0$ of the decoder 41 is further coupled through the inverter 44 to the AND gate 45 to disable this AND gate 45, the switching gate group 65 which is driven by the output of the AND gate 45 is disabled, while the switching gate group 64 is enabled so that as the output of the register for the aforementioned vacant channel in the shift register 62 the envelope value at the time of the turning-off of a key, to which the vacant channel has previously been assigned, is directly provided and circulated.

It is to be understood that when a certain channel is a vacant channel, only the address "0" of the ROM 29 is specified, and the envelope output at this time is thus "0". This means that at the timing for that vacant channel, the envelope generator 11 of FIGS. 5A and 5B which effects multiplex time-division-basis processing for eight channels, executes no envelope forming operation. Of course, at that timing no sound producing operation for that vacant channel is executed.

When a key is operated, i.e. depressed, in a state where a vacant channel is present as mentioned earlier, this operation is detected, and a key-on signal which is a one-bit time pulse is generated from the keyboard 12 through the CPU 13 to the envelope generator 11. This key-on signal (i.e., "1" signal) is coupled through the OR gates 39 and 40 to the input terminals $A_0$ and $A_1$ of the adder 32 at the timing for a vacant channel which is selected for the operated key, for instance a third channel. Thus, signals of "1" and "0" are coupled to the respective input terminals $A_0$ and $A_1$, and as the addition output of the adder 32 a signal of "1" indicating the attack status section (attack period) of the envelope is provided. Since the output of the output terminal $D_2$ of the decoder 41 is "0", the output of the inverter 49 goes to "1", and the AND gate 38 is opened at the timing for the aforementioned selected third channel. Thus, the addition output of "1" mentioned above, provided from the adder 32, is coupled through the AND gate 38 to the shift register 33, and during the attack period it is held circulated through the circulating circuit constituted by the shift register 33, OR gate 39, OR gate group 40, adder 32 and AND gate group 38. Also, at the timing for the third channel, the content "1" therefore is provided from the shift register 33, and every time it is given to the decoder 41 the output from the output terminal $D_1$ of the decoder 41 goes to "1". With this output of "1" the AND gate group 21 is enabled to couple the data for the attack time $t_A$ to the ROM 24, while also a signal of "1" is coupled to the address input terminal $A_7$ of the ROM 29. Thus, the ROM 29 selects the area of the addresses "128" to "255" for each timing for the third channel.

With the data for the attack period $t_A$ coupled to the ROM 24, the ROM 24 provides an increment data of the content corresponding to the value of the attack period $t_A$ to the input terminals $B_0$ to $B_6$ of the adder 25 at the relevant output timing. Since the output data from the shift register 26 has been coupled to the input terminals $A_0$ to $A_6$ of the adder 25, the adder 25 adds both the input data and supplies the resultant addition output from its output terminals $S_0$ to $S_6$ through the AND gate group 28, which is enabled at the timing for the third channel, to the shift register 26. While the aforementioned addition output from the shift register 26 is supplied to the input terminals $A_0$ to $A_6$ of the ROM 29, it is circulatedly coupled to the input terminals $A_0$ to $A_6$ of the adder 25 again. In this way, the envelope counter 27 which is constituted by the adder 25, AND gate group 28 and shift register 26 is caused with the start of the attack status section for the third channel to effect the operation of adding the increment data from the ROM 24 and the output of the shift register 26 and the operation of holding the addition output circulated repeatedly at the timing for the third channel until a carry signal is provided from the adder 25. Thus, the output data from the shift register 26 is progressively increased at every timing for the third channel, and the addresses "128" to "255" of the ROM 29 are successively specified from the lower address side at a speed (i.e., address specification interval) corresponding to the output timing of the increment data, whereby the waveform data of the corresponding attack status section is progressively read out from the ROM 29 and supplied to the AND gate group 30 and multiplier 31.

Meanwhile, with the appearance of the output of "1" from the output terminal $D_1$ of the decoder 41, during this attack period the AND gate group 30 is held enabled while the AND gates 55 and 56 are held disabled to hold the AND gate groups 57 and 53 disabled. Consequently, the aforementioned waveform data from the ROM 29 and data of "0" from the AND gate group 57 are coupled to the multiplier 31, which thus provides the multiplied output of "0" to the input terminals $A_0$ to $A_7$of the adder 68. Meanwhile, since the output data of "0" is coupled from the AND gate 53 to the input terminals $B_0$ to $B_7$ of the adder 68, the adder 69 also provides output data of "0". Thus, during the attack period, the aforementioned waveform data provided from the AND gate group 30 appears as the envelope output from the OR gate group 66. The envelope output is thus provided from the envelope generator 11 as data for providing an attack curve (either one of the curves in FIG. 3A) corresponding to the preset attack data (attack period $t_A$).

When a carry signal (i.e., a signal of "1") is provided from the adder 25, the output of the inverter 37 goes to "0" to disable the AND gate group 28. Thus, data of "0" is subsequently coupled to the shift register 26 at the timing for the third channel, whereupon the third channel is cleared. The carry signal is also coupled to the carry input terminal CI of the adder 32, whereupon the adder 32 executes the operation of adding "+1" to its data held during the attack period to obtain the addition output of "2" which is supplied to the shift register 33. This addition output of "2", which indicates the decay period, is subsequently held circulated in the envelope status counter 34, while it is also coupled to the decoder 41 at each timing for the third channel to let a signal of "1" to be provided from the ouput terminal $D_2$. With the change of the output from the output terminal $D_1$ to "0", the AND gate groups 21 and 30 are subsequently held disabled, while a signal of "0" is coupled to the address input terminal $A_7$ of the ROM 29 to select the area of the addresses "0" to "127".

When the decay period is started at the timing for the third channel in the manner as described, the AND gate group 22 is disabled with the output signal of "1" from the output terminal $D_2$ of the decoder 41, and the present decay data (decay period $t_D$) is supplied to the ROM 24 at every timing for the third channel. Meanwhile, the AND gate 38 is held disabled during the decay period, during which time the data of "2" mentioned above is thus held circulated in the envelope status counter 34. Further, the output of the inverter 50 is changed to "0", and the AND gate group 53 is enabled. During the decay period, the envelope counter 27 executes the operation of addition and operation of circulating the result of addition according to the content of the increment data provided from the ROM 24 in correspondence to the value of the decay time $t_D$ and at the timing of appearance of the increment data, and data which progressively increases is thus provided from the shift register 26. This data is coupled to the input terminals $A_0$ to $A_6$ of the ROM 29, and since a signal of "0" has been supplied to the address input terminal $A_7$ of the ROM 29, the address area of the addresses "0" to "127" of the ROM 29 is selected, whereby the waveform data of the decay status section is progressively read out from the addresses "0" to "127" and supplied to the AND gate group 30 and multiplier 31. The two-dot-and-bar curve b shown in FIG. 6 represents an example of the waveform data read out from the ROM 29 during the decay period in the manner as described above.

During this decay period, the output of the inverter 50 is "0", and when the data of the sustain level SUS, read out from the ROM 69, is coupled through the OR gate group 51 to the inverter group 71, the resultant inverted data is supplied from the inverter group 71 through the OR gate group 67 to the multiplier 31. The multiplier 31 multiplies the aforementioned waveform data for the decay status section provided from the ROM 29 and the inverted data and supplies the resultant multiplied output to the input terminals $A_0$ to $A_7$ of the adder 68. In FIG. 6, the one-dot-and-bar curve c represents an example of the multiplication result output.

Meanwhile, the data read out from the ROM 69 is coupled through the AND gate group 53 which is in the enabled state to the other input terminals $B_0$ to $B_7$ of the adder 68, and the adder 68 adds the data from the ROM 69 and the multiplication result output from the multiplier 31 and supplies the resultant addition output through the OR gate group 66 as the envelope output. The solid curve a shown in FIG. 6 represents an example of the envelope output for the decay status section. This envelope output curve is obtained as a result of addition of the output of the ROM 69, i.e., the sustain level SUS, to the curve c.

When the formation of the envelope curve for the decay status section in the manner as described is completed, a carry signal indicating the end of the decay period is provided from the adder 25, whereupon the third channel in the envelope counter 27 is cleared again by the output (of "1") of the inverter 37 to be ready for the counting operation for the next sustain period. Further, with the appearance of the carry signal as mentioned, the operation of incrementing "+1" in the third channel is executed to change the content in the third channel of the envelope status counter 34 to "3" which indicates the sustain and release status sections. Of course, the data of the content of "3" in the third channel is subsequently held circulated during the sustain and release periods. Also, since the data of the content of "3" is decoded by the decoder 41, at every timing for the third channel the AND gate group 23 is enabled to couple the preset release data (release period $t_R$) to the ROM 24, while also the AND gates 54 and 55 are disabled. Meanwhile, the output of the shift register 58 at the timing for the third channel is again "0", and thus the outputs of the inverter 60 and AND gate 54 go to "1" to change the output of the inverter 37 to "0", thus disabling the AND gate group 28. At the same time, since the output of the AND gate 56 is "0", the AND gate group 57 is disabled, and also the outputs of the inverter 61 and AND gate 55 go to "1" to enable the AND gate group 53. As a result, the AND gate group 28 is disabled to bring an end to the counting operation of the envelope counter 27. Further, the AND gate group 57 is disabled, and the output from the output terminal $D_2$ of the decoder 41 goes to "0". As a result, the output of the inverter 50 goes to "1". With this result and also with the change of the output data of the inverter group 71 to "0", data of "0" is coupled through the OR gate group 67 to the multiplier 31. Thus, the multiplier 31 provides at this time a multiplication result output of "0" which is supplied to the input terminals $A_0$ to $A_7$ of the adder 68.

Meanwhile, since the AND gate group 53 has been disabled, the data of the sustain level SUS read out from the ROM 69 is coupled to the other input terminals $B_0$ to $B_7$ of the adder 68, which thus provides data of the sustain level SUS which is supplied through the OR gate 66 as the envelope output.

The operation described above after the end of the decay period is continued until the key to which the third channel has been assigned is released, and the sustain status section of the envelope waveform is formed according to the sustain level SUS preset by the sustain lever. The sustain period $t_S$ (FIG. 2) is variable with the period during which the relevant key is "on".

When the key is released, a key-off signal (one-bit time pulse) is provided from the keyboard 12 through the CPU 13 to the AND gate 45. Since the AND gate 45 has been enabled, the key-off signal is coupled through the AND gate 45 and OR gate group 40 to the input terminals $A_0$ and $A_1$ of the adder 32, but the count of "3" in the envelope status counter 34 for the third channel remains unchanged. Meanwhile, the key-off signal is also coupled through the AND gate 45 and OR gate 59 or AND gate 47 in the enable state to the shift register 58 to set the third channel therein. The set state of the third channel thus obtained is subsequently held circulated through the circulating circuit constituted by the shift register 58, OR gate 59 and AND gate 47. The key-off signal mentioned above is further coupled through the AND gate 45 and OR gates 44, 43 and 36 to the inverter 37 to change the output thereof to "0", and this output of "0" is coupled to the AND gate group 28 to disable this AND gate group. As a result, the third channel in the envelope counter 27 is cleared again, and subsequently with the set output (of "1") of the shift register 58 for the third channel the inverter 37 provides output of "1" at the timing for the third channel, and thus the AND gate group 28 is held enabled during the release period in the third channel. Since the output from the output terminal $D_3$ of the decoder 41 is "1", during this release period the AND gate group 23 is held enabled to couple the release data (release period $t_R$) to the ROM 24. Thus, when the AND gate group 28 is enabled after the aforementioned key-off instant, the envelope counter 27 is caused to execute counting operation at a speed determined by the release period $t_R$ and supplies the count output to the input terminals $A_0$ to $A_6$ of the ROM 29. Since a signal of "0" has been supplied to the address input terminal $A_7$ of the ROM 29, the area of the addresses "0" to "127" of the ROM 29 is selected, and the waveform data therein is read out and supplied to the AND gate group 30 and multiplier 31.

Meanwhile, since the key-off signal is coupled directly to the gates of the switching gate group 65 or through the inverter 63 to the gates of the switching gate group 64, at the time of the appearance of the key-off signal the switching gate group 65 is enabled while the switching gate group 64 is disabled. Thus, the envelope output at the time of the aforementioned key-off instant, in the instant case the sustain level SUS, is coupled through the switching gate group 65 to the shift register 62, and during the following release period the sustain level SUS in the third channel is held circulated through the circulating circuit constituted by the shift register 62 and switching gate group 64. The sustain level SUS is also supplied to the AND gate group 57, which is held enabled during the release period, and also supplied through the OR gate 67 to the multiplier 31. The multiplier 31 thus multiplies the sustain level SUS by the waveform data from the ROM 29 and supplies the resultant multiplication output to the input terminals $A_0$ to $A_7$ of the adder 68. Meanwhile, the AND gate group 53, which is disabled with the appearance of a signal of "0" from the inverter 61 inverting the output of "1" from the shift register 58 for the third channel, is coupled to the input terminals $B_0$ to $B_7$ of the adder 68, and thus the output of the adder 68 becomes equal to the multiplication output of the multiplier 31, that is, the envelope output becomes equal to the multiplication output. In other words, during the release period, during which the waveform data representing an attenuating waveform like that of a discharging curve is progressively read out from the ROM 29, an envelope output as a result of the multiplication of the waveform data by the sustain level SUS, i.e., the release status section of the envelope waveform, the amplitude of which gradually approaches from the sustain level SUS at the key-off instant to zero level, is formed.

With the appearance of the carry output indicating the end of the release status section in the third channel from the adder 25, the third channel in the envelope counter 27 is cleared by the carry signal in the manner as described above to be ready for the next keying operation. Further, with the carry signal the third channel in the envelope status counter 34 is cleared, and the count thereof becomes "0". In consequence, an output of "1" is provided from the output terminal $D_0$ of the decoder 41 at every timing for the third channel, and this signal of "1" is inverted through the inverter 46 to a signal of "0" to disable the AND gate 47. Thus, the third channel in the shift register 58 is reset at the time of the end of the release status section.

When the aforementioned key is turned off during the attack period of its envelope, during which time the count of the envelope status counter 34 for the third channel is "1" as mentioned previously and a signal of "1" is provided from the output terminal $D_1$ of the decoder 41 for every timing of the third channel, a key-off signal that is generated at this instant is coupled through the AND gate which is in the enabled state or the OR gate group 40 to the adder 32, whereupon the count of the envelope status counter 34 for the third channel is changed to "3". The key-off signal is also coupled through the OR gate 59 and the AND gate 47 which is in the enabled state to the shift register 58 to set the third channel in the shift register 58, whereupon the aforementioned release period is set for the third channel during the attack period. In this case, the amplitude of the attach status section at the key-off instant is set in the third channel of the shift register 62. Also, the envelope counter 27 is temporarily reset at the key-off instant for counting operation at a speed determined by the release status data in lieu of the previous attack status data. In this way, the envelope waveform begins to be attenuated from the amplitude value in the attack status section at the key-off instant, whereby the release status section of envelope is formed. The curve a in FIG. 7 represents the release status section of the envelope waveform obtained from the key-off instant during the attack period. When the release status section is ended, the third channel in the envelope counter 27, envelope status counter 34 and shift register 58 is reset.

In case when the aforementioned key is turned off during the decay period of the envelope, during which time the count in the third channel of the envelope status counter 34 is "2" and a signal of "1" is provided from the output terminal $D_2$ of the decoder 41 at every timing for the third channel, a key-off signal that is provided at this time has an effect of forcibly changing the count of the envelope status counter 34 to "3", while the third channel in the shift register 58 is set. In this way, the release period is set in the third channel during the decay period. At this time, the amplitude of the decay status section at the key-off instant is set in the shift register 62. Meanwhile, at the key-off instant the envelope counter 27 is temporarily reset to start counting operation at a speed determined by the release data in lieu of the previous attack data. As a result, the envelope waveform turns to be attenuated from the amplitude value of the decay status section at the key-off instant as the release status section. The curve b in FIG. 7 represents the release status section of the envelope waveform obtained from the key-off instant, at which the release period is interrupted. After the release status section is ended, the third channel in the envelope counter 27, envelope status counter 34 and shift registers is all reset.

If it is desired to set the sustain level SUS in this example to zero level so as to obtain an envelope for a string musical instrument such as piano or a guitar, the output of the OR gate group 70 is made "0" to make the output of the inverter 72 "1" and thus enable the AND gate group 48. When the envelope in the aforementioned third channel gets into the decay status section, the count in the third channel of the envelope status counter 34 is changed to "2", so that an output of "1" is provided from the output terminal $D_2$ of the decoder 41 at every timing for the third channel. Every time this outut of "1" is provided, the output of the AND gate 48 goes to "1" and coupled to the AND gate 35, which is however held disabled until a carry signal is provided from the adder 25 at the end of the decay status section. When the carry output is provided at the end of the decay status section, the output of the AND gate 35 goes to "1" to change the output of the inverter 49 to "0" so as to disable the AND gate 38. Thus, the third channel of the envelope status counter 34 is reset, i.e., forcibly rendered to be a vacant channel, at the time of the end of the decay status section although the key is still "on". The third channel is thus made available as a vacant channel to be assigned to a key that is subsequently operated. It will be appreciated that the utility of channels can thus be improved to permit processing (assignment of channels) with respect to an increased number of simultaneously "on"-state keys.

While the description so far has been made in connection with the operation that takes place in case of the operation of a single key, to which the third channel among the eight channels provided in the envelope generator is assigned, when two or more keys are simultaneously turned on, the operation of forming envelope is brought about for the individual channels, which are assigned to the respective keys, on a time division basis. In this case, the operation with respect to each channel is the same as the aforedescribed operation brought about with the operation of the key to which the third channel is assigned. When nine or more keys are simultaneously operated while only eight channels are available for assignment, one of these nine keys is held in a stand-by state until a vacant channel capable of assignment is obtained.

While in the above embodiment the waveform data of the attack, decay and release status sections of the envelope waveform are stored in the ROM 29, the number of address bits and number of output bits for these data may be any desired numbers. Further, for obtaining the data of the attack, decay and release status sections of the envelope waveform, the count output of the envelope counter 27 may be directly subjected to the encoding processing instead of using a waveform memory such as the ROM 29. Further, while in the above embodiment the attack, decay, sustain and release data are obtained using switch levers, they may also be obtained using a push button system or ten key system.

With the above embodiment, which is an envelope control system for electronic musical instrument for effecting the envelope control with an envelope generator having an entirely digital circuit construction, unlike the prior art analog envelope generator using a CR charger/discharger, the changes of the envelope characteristics and other changes of circuit parameters that might otherwise result from changes of the circuit constants of the CR charger/discharger in long use can be reliably eliminated, thus permitting steady and stable envelope control over a long period, which is very useful in the performance of music. In addition, since the envelope generator has an entirely digital circuit construction, it can be readily implemented with LSI, that is, its size can be reduced. Further, with the digital circuit it is possible to permit time-division-basis processing and thus realize envelope control for a plurality of channels with a single envelope generator circuit, which is very convenient.

Figure 8:
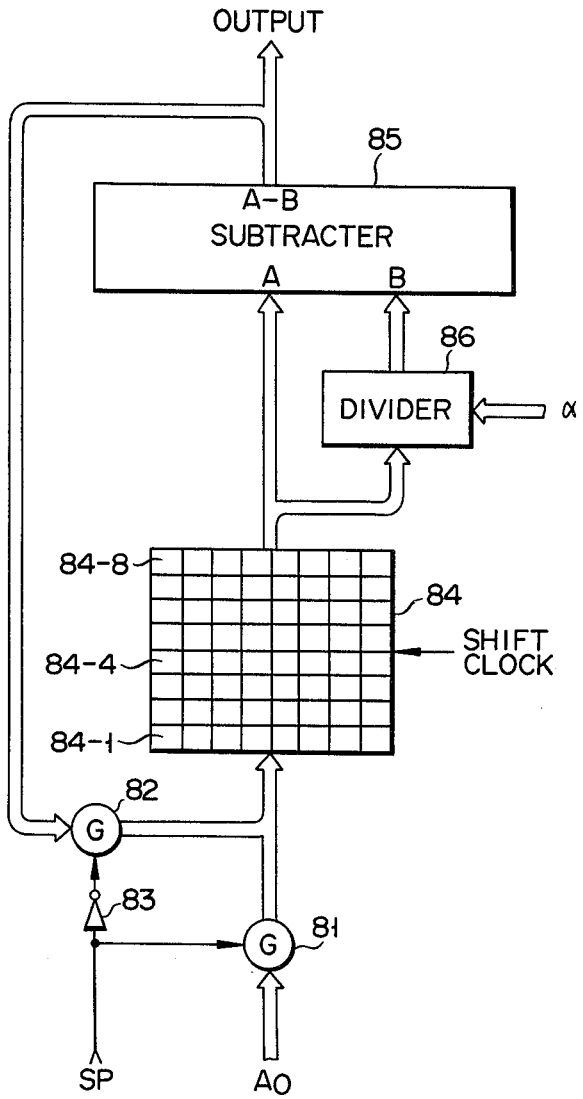
FIG. 8 is a schematic showing the envelope generator in a different embodiment.

FIG. 8 shows an exponential function generator for the envelope generator in an electronic musical instrument. In this function generator, calculation on the basis of an equation of an exponential function given as $$A_n = A_{n-1} - \frac{A_{n-1}}{\alpha} = \left(1 - \frac{1}{\alpha}\right)^n A_0 \tag{1}$$

where n is an integer, $\alpha$ is a positive number, and $A_0$ is an initial value, is repeatedly performed to replace the role of the ROM 29 in FIG. 5A. The attenuation waveform that is obtained on the basis of the equation (1) is utilized for the control of the release status section of the envelope.

When a key for a certain note is released, a start pulse SP is supplied from a key input section (not shown) provided in the CPU 13 to the generator at a timing corresponding to the note of the operated key, and it is coupled directly to a gate circuit 81 and also through an inverter 83 to a gate circuit 82. In this way, the gate circuits 81 and 82 are controlled for gating by the start pulses SP. At the time of the release of the aforementioned key, i.e., at the key-off instant, the initial value $A_0$ is provided from the CPU 13 and coupled through the gate circuit 81 to a first stage shift register 84-1 in a shift register group 84. This shift register 84 includes eight 8-bit shift registers 84-1 to 84-8 connected in cascade and is driven by a shift clock to successively shift the aforementioned initial value $A_0$ or the subtraction output of a subtractor 85 coupled to its first stage to the following stages. With this construction of the shift register group 84, at most eight envelope waveform forming circuits for respective eight channels corresponding to eight simultaneously operated keys can be formed on a time division basis. The output data from the eighth stage register 84-8 of the shift register group 84 is coupled as a number to be substracted to an input terminal A of the subtractor 85, and is also coupled to a divider 86 for division therein by the constant $\alpha$ (which is given by a predetermined switch output from the key input section) to provide the result which is supplied as a number from which the substraction is to be made to an input terminal B of the subtractor 85. The subtractor 85 executes the subtraction of the input data coupled to its input terminals A and B and supplies the resultant subtraction output (A−B) as exponential function output to, for instance, the multiplier 15 in FIG. 1 for multiplication by a musical sound waveform signal corresponding to the note of the aforementioned key and also through the gate circuit 82 to the first stage 84-1 of the shift register group 84. The start pulse SP mentioned above is a one-shot pulse provided at the key-off instant, and with the appearance of this start pulse the gate circuit 81 is enabled to couple the initial value $A_0$ to the first stage 84-1 of the shift register 84. Subsequently, the gate circuit 82 is enabled by the output of the inverter 83, whereupon the subtraction output from the subtractor 85 is coupled through the gate circuit 82 to the first stage 84-1 of the shift register group 84 for shifting therethrough. In this way, the release status section of the envelope waveform corresponding to the aforementioned released key is obtained through repetitive calculation based upon the exponential function given by the equation (1). The divider 86 is constructued with a shift circuit such that it shifts the input data by four bits to the right to obtain an output data of, for instance, 1/16 of the magnitude of the input data when the constant $\alpha$ is 16 while it shifts the input data by three bits to the right to obtain an output data of $\frac{1}{8}$ of the magnitude of the input data when the constant $\alpha$ is 8.

Figure 11:
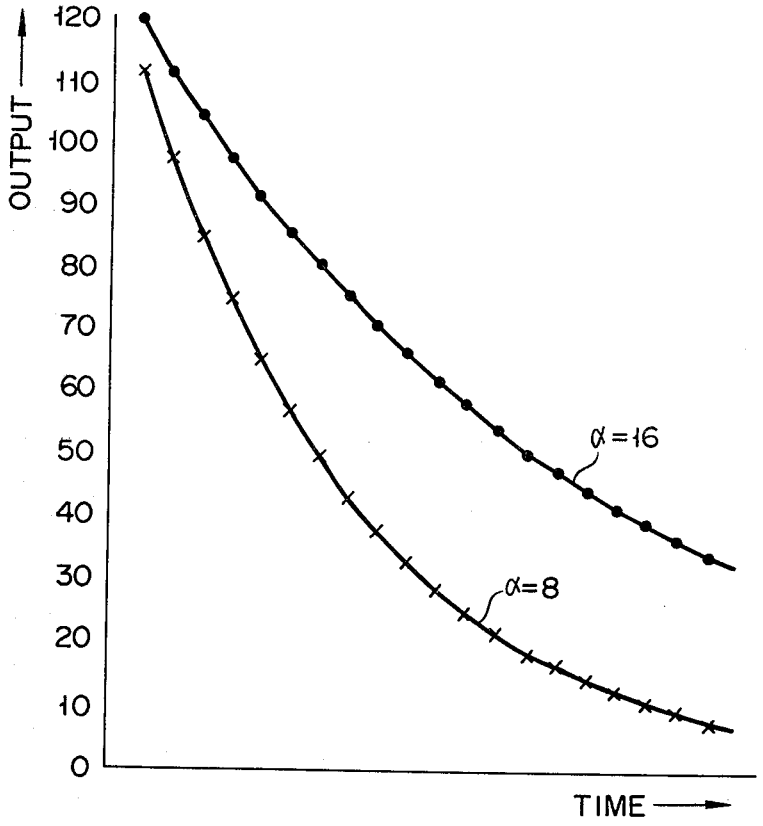
FIG. 11 is a graph showing envelope waveform attenuation curves for $\alpha=16$ and $\alpha=8$.

Now, the operation of this embodiment will be described with reference to FIGS. 9 to 11. For setting the constant $\alpha$ to, for instance, 16, a predetermined switch in the key input section is previously set to a corresponding position. Then, when a key for a certain note is released after starting the performance, a one-shot start pulse SP is provided at the timing corresponding to the release of the key, i.e., at the key-off instant, from the key input section, thus enabling the gate circuit 81 and disabling the gate circuit 82. Thus, at the aforementioned key-off instant, the initial value $A_0$ of $A_0=128$ (as shown in FIG. 9, in which the numeral values in the left hand column are expressed as binary display in the right hand column) is supplied from the CPU 13 through the gate circuit 81 to the first stage 84-1 of the shift register 84. This initial value $A_0$ is then progressively shifted through the successive stages of the shift register group 84, and as it appears from the eighth stage it is coupled to the input terminal A of the subtractor 85 and also the divider 86. In the divider 86, the initial value $A_0$ is shifted by four bits to the right to produce a data of "8", which is 1/16 of the magnitude of the input and is supplied to the input terminal B of the subtractor 85. The subtractor 85 subtracts the data of "8" from the initial value $A_0$ of $A_0=128$ to produce a subtraction result output of "120" which is supplied as the envelope output to the multiplier 15, whereupon the attenuation of the music sound of the corresponding note is started. At this time, the subtraction output of "120" is coupled through the gate circuit 82, which has been enabled, to the first stage 84-1 of the shift register group 84. Thus, in the next waveform calculation based on the exponential function, the number from which the subtraction is made in the subtractor 85 is "120" while the number which is subtracted is "8", and thus the second subtraction output is "112". In this way, the envelope output, i.e., the number from which the subtraction is made, is progressively reduced as shown in FIG. 9 with the repetition of the calculation based upon the exponential equation (1), that is, the crest value of the envelope waveform is progressively attenuated, and the music sound of the released key is correspondingly attenuated to zero. In FIG. 11, the upper curve represents the output obtained with the progress of the repetitive calculation as described above. In case when two or more keys having been concurrently depressed are simultaneously released, the initial value of $A_0=128$ is successively coupled to the first stage 84-1 of the shift register group 84 at the timings corresponding to the notes of the individual released keys, and the operation as described above is subsequently brought about on a time division basis at the timings of the individual keys.

When controlling the release status section of the envelope waveform with the attenuation form for which the constant $\alpha$ is set to "8", the predetermined switch in the key input section is switched to the corresponding position before starting the performance. In this case, when a key for a certain note is released, the initial value of $A_0=128$ is coupled to the first stage 84-1 of the shift register group 84 at the timing for that key. Then, the number "128" from which the subtraction is to be made is coupled to the input terminal A of the subtractor 85, while the number "16" which is to be subtracted is coupled to the input terminal B. As a result, the first subtraction output of "112" is obtained as the envelope output and is coupled to the first stage 84-1 of the shift register group 84. Thereafter, the envelope output, i.e., the number from which the subtraction is made, is progressively reduced as the calculation on the equation (1) of the exponential function is repeated, and the crest value of the envelope waveform is progressively reduced to reduce the music sound of the released key to zero. The lower curve in FIG. 11 represents the output obtained as the result of the calculation with the constant $\alpha$ set to $\alpha=8$.

While in the above embodiment the release status section of the envelope waveform has been controlled using the attenuation waveform obtained through the repetitive calculation according to an exponential function, it is also possible to control the decay and attack status sections of the envelope waveform. In the case where the attack status section is controlled, a signal obtained by inverting the subtraction output in the above embodiment may be used as the envelope output. Further, while in the above embodiment the subtraction output of the subtractor 85 has been used as the envelope output, it is also possible to make use of the output of the shift register group 84. Further, the constant $\alpha$ may be set to any desired value, and also the equation (1) of the exponential function for the calculation of the waveform is by no means limitative.

Further, in the case where the release status section is controlled, the initial value $A_0$ may be used as the envelope output at the key-off instant, and by so doing a continuous envelope output can be obtained.

It is to be appreciated that with the above embodiment, which is an envelope waveform control for electronic musical instrument for obtaining an envelope waveform through repetitive calculation based on an equation of an exponential function, the large capacity ROM or complicated decoding circuit as in the previous first embodiment is not needed, and ready envelope control can be obtained with an arithmetic circuit of a very simple construction.

Figure 12A:
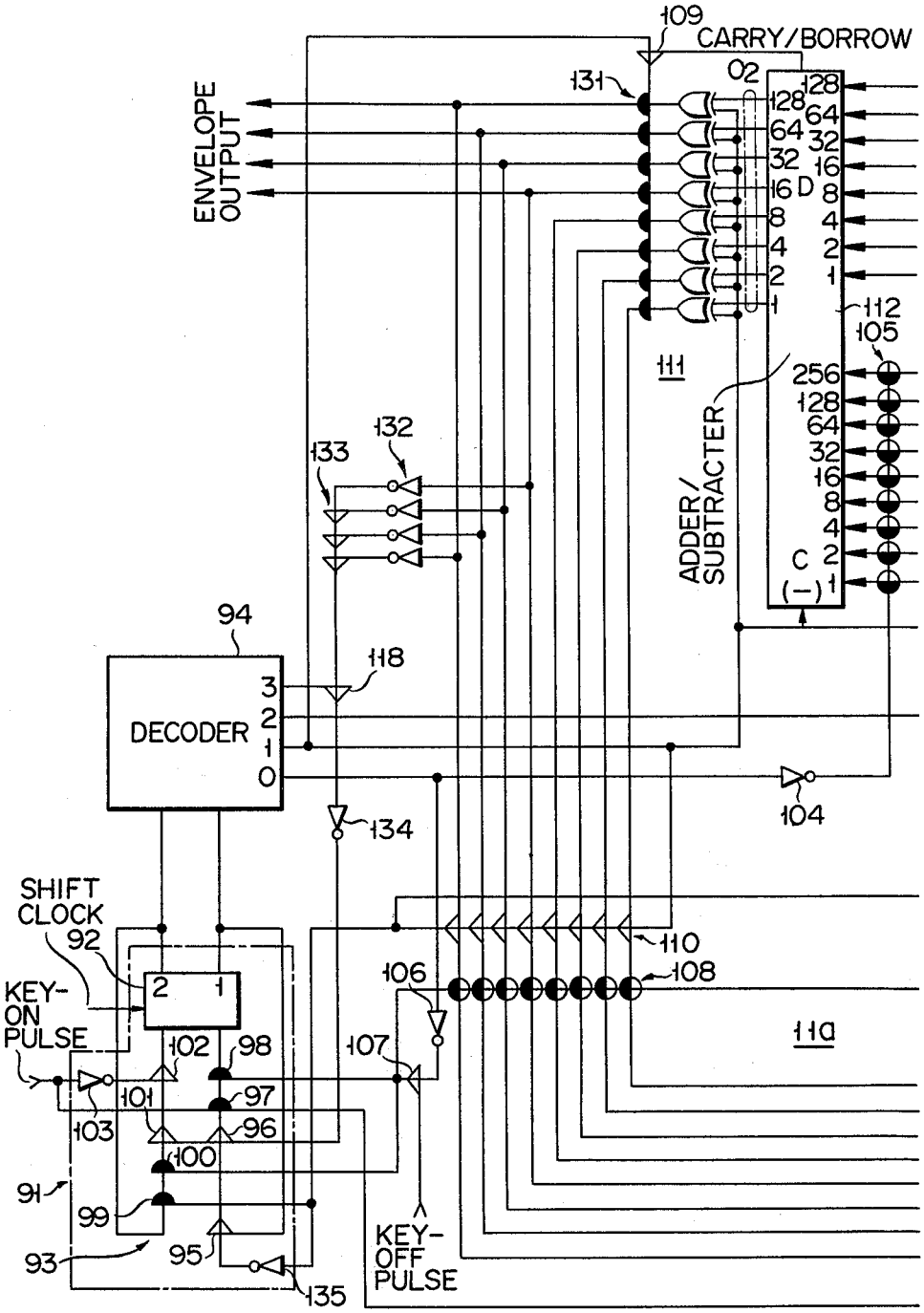
FIGS. 12A and 12B are schematic representations of the envelope generator used in a further embodiment.
Figure 12B:
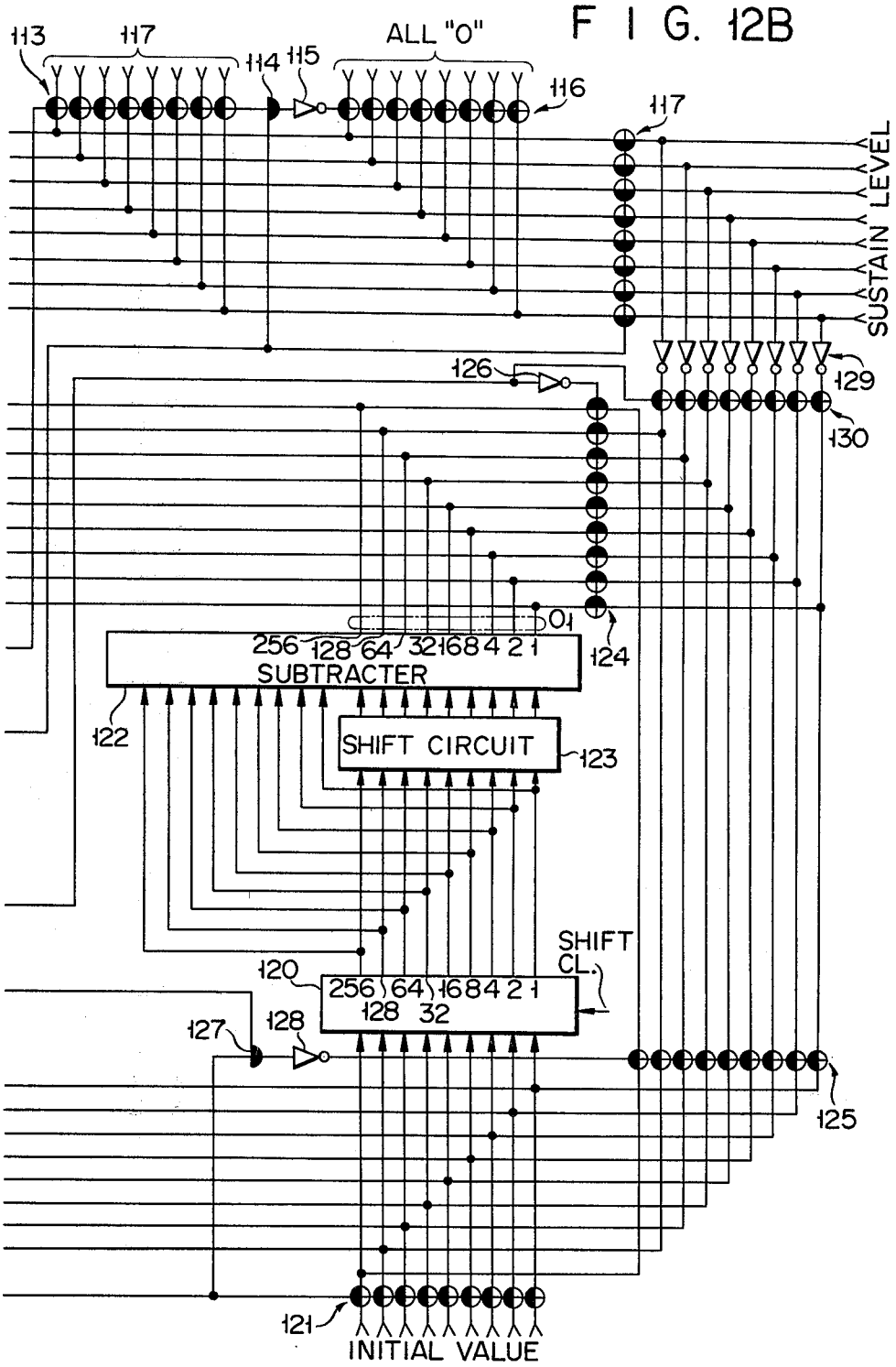

FIGS. 12A and 12B show the circuit construction of an envelope generator in a further embodiment. Designated at 91 in the FIG. 12A is an envelope status counter, which includes a shift register 92 and a gate circuit 93 provided on the input side of the shift register 92. The envelope status counter 91 indicates the status of the attack, decay, sustain and release status sections of the envelope being formed and also vacant channels to be described later as the content of its count.

Again in this embodiment, eight different envelopes can be formed with the circuit construction of FIGS. 12A and 12B through time-division-basis multiplex processing. That is, all the shift registers in FIGS. 12A and 12B have a capacity for eight channels. More particularly, each of the shift registers has eight registers connected in cascade, and the input data coupled to the first stage register is progressively shifted to the following stages under the control of a shift clock.

The shift register 92 has eight 2-bit registers connected in cascade. Its two bit outputs are supplied to a decoder 94. Of these two bit outputs, the lower bit (i.e., first bit) output is also fed back through AND gates 95 and 96 and OR gates 97 and 98 to the input side. The other or upper bit (i.e., second bit) output is also fed back through OR gates 99 and 100 and AND gates 101 and 102 to the input side.

When a certain key is depressed, a vacant channel is selected for assignment to the depressed key by the CPU 13 if one or more vacant channels are available. At this time, a key-on pulse (one-shot time pulse is produced from the keyboard 12 at the key-on instant and is coupled to the envelope status counter 91 at a timing set for the aforementioned vacant channel to be fed through the OR gate 97 and 98 to the first bit of the first register (or register of the timing for the vacant channel) and also through an inverter 103 and the AND gate 102 to the second bit of the aforementioned register. As a result, the state of the vacant channel mentioned above is changed from "0" to "1" (both being in decimal expression) which state is held circulated through the aforementioned circulating circuit, while at the same time the formation of the envelope waveform for the depressed key is started in the assigned channel.

The decoder 94 decodes the output of the shift register 94 for successive channels. When the contents of the respective channels are "0", "1", "2" and "3", a signal of binary logic level "1" is provided from output terminals "0", "1", "2" and "3" which correspond to these contents. The output from the output terminal "0" is coupled through an inverter 104 to a switching gate group 105 for controlling these gates, and is also coupled through an inverter 106 to an AND gate 107. The AND gate 107 is gate controlled by a key-off pulse (one-shot time pulse) provided from the keyboard when the key is released, and its output is coupled through the OR gate 98 to the lower bit of the shift register 92 and also coupled to a switching, gate group 108 for gate controlling these gates.

The output from the output terminal "1" mentioned above is coupled to an AND gate 109, an AND gate group 110, the first input terminals of an exclusive OR gate group 111 and to a subtract instruction input terminal (−) of an adder/subtractor 112, and is also coupled through the individual gates of a switching gate group 113, an OR gate and an inverter 115 to a switching gate group 116.

The output from the output terminal "2" mentioned above is coupled to the OR gate 114 mentioned above, and is also supplied as gate control signal to the gates of a switching gate group 117. The output from the output terminal "3" mentioned above is coupled as gate control signal to an AND gate 118.

A shift register (arithmetic register) 120 has eight 9-bit registers connected in cascade. When a key is depressed, i.e., at a key-on instant, a predetermined initial value for the calculation of exponential function waveform is coupled through a switching gate group 121, which is enabled by the key-on pulse, to the shift register 120, to be shifted therethrough under the control of a shift clock and provided from the eighth stage register to an input terminal A of a subtracter 122 and also through a shift circuit 123 to an input terminal B of the subtracter 122. The data of the result of the exponential function calculation obtained from the subtracter 122 is fed back through switching gate groups 124 and 125, which are held enabled during the attack period of the envelope for the aforementioned key, to the shift register 120. In this way, the data of the result of the exponential function calculation which is repeated with the aforementioned initial value as a reference is circulated through the circulating circuit mentioned above until the attack period is ended. It is also coupled through the switching gate group 105 to an input terminal C of the adder/subtracter 112. The switching gate group 124 mentioned above is gate controlled by a signal from an inverter 126 which inverts the output from the AND gate group 110, while the switching gate group 125 is gate controlled by a signal from an inverter 128 which inverts the output of the OR gate 127.

At the end of the aforementioned attack period, data from an inverter group 129 which inverts a sustain level SUS preset by a sustain lever (not shown) is coupled through switching gate groups 130 and 125, which are in the enabled state at this time, to the shift register 120. The switching gate group 130 is thus controlled by a gate control signal which is provided from the aforementioned AND gate group 110, which is gate controlled by the output (called envelope data) of an OR gate group 131 as will be described later. The subtracter 122 and shift circuit 123 resume the exponential function waveform calculation with the inverted sustain level data coupled to the shift register 120 as reference with the start of the decay period and repeat the aforementioned calculation while circulating the calculation result data through the circulating circuit. The calculating result data is also coupled through the switching gate group 105 to the adder/subtracter 112. When the decay period is ended, i.e., in the instant embodiment with the reaching of the data corresponding to the aforementioned sustain level SUS by the envelope output to be described later, the exponential function waveform calculation mentioned above is continually repeated until the key-off instant, until which time the aforementioned envelope output is held as the data corresponding to the aforementioned sustain level SUS. When the key is released, the envelope data at this key-off instant is coupled through the switching gate group 108, which is enabled at this time, to the shift register 120. When the release period is started in this way, the subtracter 122 and shift circuit 123 resume the exponential function waveform calculation with the aforementioned envelope data coupled to the shift register 120 as reference and repeat it while circulating its result to the circulating circuit mentioned above. The exponential function waveform calculation result data is also coupled through the switching gate group 105 to the input terminal C of the adder/subtracter 112. When the envelope output becomes "0", the calculation is stopped, whereupon the relevant channel is restored to the vacant channel.

For repeatedly executing the aforementioned calculation, the subtracter 122 effects subtraction (A−B) of the input data coupled to the input terminals A and B. The shift circuit 123 provides data obtained as a result of shifting of its input data to the right by, for instance, four bits, and thus the output data is 1/16 time the input data.

The adder/subtracter 112 executes, when a signal of "1" prevails at its subtract instruction input terminal (−), i.e., only during the attack period, the subtraction (C−D) of the data coupled to the input terminals C and D, while when a signal of "0" prevails, i.e., during the vacant channel, decay, sustain and release periods, it executes the addition (C+D) of the input data. The results of the subtraction and addition are provided from an output terminal $O_2$. When a carry or a borrow is generated during the execution of the addition or subtraction, a carry or borrow signal is provided from a carry/borrow output terminal CARRY/BORROW to be supplied as a gate control signal to the AND gate 109. Meanwhile, the output data from the adder/subtracter 112 is coupled to the second input terminals of the exclusive OR gate group 111 mentioned above. The output of the exclusive OR gate group 111 is supplied through the OR gate group 131 as the aforementioned envelope data. In this embodiment, of this envelope data (which is an 8-bit data) the upper four bits are provided as the aforementioned envelope output. When the envelope output becomes "0" (that is, "0000" in the binary expression), the operation of the envelope formation is stopped, and for rendering the relevant channel to a vacant channel the envelope output is coupled through an inverter 132 to an AND gate group 133,, and also the output thereof is coupled through the inverter 118 and inverter 134 to the AND gates 96 and 101. At this time, if a certain channel is a vacant channel, from the switching gate group 105 which is in the disabled state output of "0" (all eight bits being "0") is coupled to the input terminal C of the adder/subtracter 112, while from the switching gate group 116 which is also in the disabled state output of "0" (all eight bits being "0") is coupled to the input terminal D. The adder/subtracter 112 thus adds both the input data of "0" and "0" and provides the resultant addition data of "0" from the output terminal $O_2$. Further, during the attack period, the calculation result data from the subtracter 122 is coupled to the input terminal C of the adder/subtracter 112, while data of "127" is coupled through the switching gate group 113 in the enabled state to the input terminal D. Thus, the adder/subtracter 112 executes the subtraction (C−D) and provides the result thereof. Further, during the decay and sustain periods, the exponential function waveform calculation result data mentioned above is coupled to the input terminal C of the adder/subtracter 112, while the sustain level SUS is coupled through the switching gate group 117 in the enabled state to the input terminal D. The adder/subtracter 112 thus executes the addition (C+D). During the release period, the exponential function waveform calculation result data is coupled through the switching gate group 105 in the enabled state to the input terminal C of the adder/subtracter 112, while the aforementioned data of "0" is coupled though the switching gate group 116 in the enabled state to the input terminal D. The adder/subtracter 112 thus executes the addition (C+D).

The output of the AND gate group 110 is further coupled to the OR gate 99 in the envelope status counter 91 and also coupled through the inverter 135 to the AND gate 95 for controlling the status of the envelope.

Now, the operation of the above embodiment will be described. Before starting the performance with the electronic musical instrument, the sustain lever is set to a desired position so that a desired sustain level SUS (for instance a level corresponding to a numerical value data of "200") is provided from the sustain lever. In the first place, the operation in case when a certain channel is a vacant channel will be described. In this case, the count of the envelope status counter 91 with respect to that vacant channel, i.e., the content of the register in the shift register 92 for that vacant channel, is "0". Thus, the content of "0" is provided from the shift register 92 at the timing for that vacant channel, and every time it is given to the decoder 94 a signal of "1" is provided only from the output terminal "0" of the decoder 94. This "1" signal is inverted by the inverter 106 to a "0" signal which is coupled to the AND gate 107 to change the output thereof to "0". The output signal of "0" from the AND gate 107 is coupled to the OR gate 98. Since at this time the other input to the OR gate 98, i.e., the output of the OR gate 97, is "0", an output of "0" is provided from the OR gate 98 to the first bit of the first stage register of the shift register 92. At the same time, an output of "0" from the AND gate 102 is coupled to the second bit of the first stage register of the shift register. Thus, data of "0" is coupled again to the shift register 92 at the timing for the aforementioned vacant channel, and the operation as described above is repeated with respect to the vacant channel.

Meanwhile, with the output of "1" from the output terminal "0" of the decoder 94 the output of the inverter 104 goes to "0". Thus, at the timing for the aforementioned vacant channel the switching gate group 105 is disabled, and data of "0" is coupled to the input terminal C of the adder/subtracter 112. At the same time, since the output of the OR gate 114 is "0", i.e., the output of the inverter 115 is "1", the switching gate group 116 is enabled to provide output of "0" (all bits being "0") which is coupled to the input terminal D. Since both the switching gate groups 113 and 117 are held disabled at this time, neither data of "127" nor the data of sustain level SUS is coupled to the input terminal D. With the data of "0" and "0" coupled to the respective input terminals C and D of the adder/subtracter 112 and a signal of "0" coupled to the subtract instruction input terminal (−) of the adder/subtracter, these data "0" and "0" are added at the timing for the vacant channel, and the resultant addition output is provided from the output terminal $O_2$ of the adder/subtracter 112 and supplied to the first input terminals of the exclusive OR gate group 111. Since a signal of "0" is coupled to each of the second input terminals of the exclusive OR gate group 111, the output of each gate of the exclusive OR gate group 111 is "0" which is supplied to the OR gate group 131. However, since the other input to the OR gate group 131, i.e., the output of the AND gate 109, is "0" at this time, the output of the OR gate group 131, i.e., the envelope data, at the timing for the aforementioned vacant channel is "0" (all bits being "0"), and thus the envelope output as the upper four bits data is "0" (all bits being "0").

Further at the timing for the aforementioned vacant channel, at which time the output of the AND gate group 124 is "0", the switching gate group 124 is enabled while the switching gate group 130 is disabled. Further, at the same timing the switching gate groups 108 and 121 are disabled while the switching gate group 125 is enabled. As a result, at the timing for the aforementioned vacant channel, a certain data is held circulated through a circulating circuit which is constituted by the shift register 120, shift circuit 123, subtracter 122 and switching gate group 124, and subsequently the operation as described previously is repeatedly effected at every timing for the vacant channel.

It is to be understood that when certain channel is a vacant channel, the envelope output data is "0", the envelope generator of FIGS. 12A and 12B for executing the time-division-basis multiple processing for eight channels does not execute the operation of envelope formation at the timing for the aforementioned vacant channel, and thus no sound producing operation is effected for that vacant channel.

When a key is depressed in the presence of one or more vacant channels, the key-on operation is detected, and a key-on signal which is a one-bit timing pulse is generated from the keyboard 12 and supplied to the envelope generator 11*a*. This key-on signal (i.e., a signal of "1") is coupled through the OR gates 97 and 98 to the first bit of the first stage register of the shift register 92 at the timing for, for instance, the third channel. Meanwhile, the output of "0" from the inverter 103, the output of which becomes "0" with the appearance of the key-on pulse (of "1"), is coupled through the AND gate 102 to the second bit of the first stage register mentioned above. Thus, the content "1" of the third channel in the shift register 92 is changed to "1", indicating the status of the third channel to the attack period. With the appearance of the content of "1" in the third channel from the shift register 92, it is supplied to the decoder 94 and decoded therein, whereby only the output from the output terminal "1" for the third channel becomes "1".

The data of "1" of the first bit among the third channel data of "1" provided from the shift register 92, is coupled through the AND gates 95 and 96, which are enabled at the timing of appearance of that output, to the first bit of the first stage register of the shift register 92. At the same time, the data of "0" of the second bit is coupled through the OR gates 99 and 100 and the AND gates 101 and 102, which are enabled at the timing for that output, to the second bit of the first stage register of the shift register 92. As a result, the aforementioned data of "1" is coupled again to the shift register 92 at the timing for the third channel. In the above way, the data of "1" provided from the eighth stage register of the shift register 92 at the timing for the third channel is coupled through the aforementioned circulating circuit to the first stage register of the shift register 92 and held circulated through the circulating circuit during the attack period in the third channel. At the same time, a signal of "1" is provided from the output terminal "1" of the decoder 94 at every timing for the third channel.

Meanwhile, at the time of the appearance of the key-on pulse for the third channel, this key-on pulse (of "1") is coupled through the OR gate 127 to the inverter 128, and consequently the switching gate group 125 is held disabled only at the time of the presence of the key-on pulse and is held enabled at all other times. Further, since the output of the AND gate group 110 is "0" until the end of the attack period of the third channel, the output of the inverter 126 is held to be "1" during this attack period. Thus, during this period, the switching gate group 124 is enabled while the switching gate group 130 is held disabled at the timing for the third channel. Further, only at the time of the presence of the key-on pulse, the switching gate group 121 is held enabled by this key-on pulse (of "1"). As a result, at the time of the appearance of the key-on pulse, the initial value for the calculation of the exponential function waveform, for instance data of a numerical value "383", is coupled to the register of the first stage of the shift register 120. When this numerical value data of "383" is provided from the eighth stage register of the shift register 122, it is coupled to the input terminal A of the subtracter 122 and also to the shift circuit 123. The shift circuit 123 shifts the numerical value data "383" by four bits to the right to obtain a data "23", which is supplied to the input terminal B of the subtracter 122. Thus, the result of subtraction (A−B) in the subtracter 122 becomes "360", which is coupled through the switching gate group 105 in the enabled state to the input terminal C of the adder/subtracter 112 and is also coupled through the switching gate groups 124 and 125 in the enabled state to the shift register 120.

At the timing at which the aforementioned data "360" is coupled to the input terminal C of the adder/subtracter 112, numerical value data of "127" is coupled through the switching gate group 113 which is enabled at this timing, while also data of "1" is coupled to the subtract instruction input terminal (−), i.e., the subtract instruction is given to the adder/subtracter 112. Thus, the adder/subtracter 112 executes the subtraction (C−D), and the resultant output of "233" (which corresponds to "11101001") is provided from the output terminal $O_2$ to the first input terminals of the exclusive OR gate group 111. Since a signal of "1" is given to the second input terminals of the exclusive OR gate group 111 at every timing for the third channel, data of "22" (corresponding to "00010110") which is inverse to the aforementioned input data "233", is provided from the exclusive OR gate group 111 to the OR gate group 131. Since the other input to the OR gate group 131, i.e., the output of the AND gate 109, is "0", the output of the OR gate group 131, i.e., the envelope data, becomes "22", while the envelope output obtained as the upper four bits of the envelope data, is "1" (which corresponds to a binary expression of "0001"). While the envelope data mentioned above is supplied to the switching gate group 108, it is not provided through this switching gate group 108, which is held disabled. Further, while the envelope output mentioned above is coupled through the inverter group 132 to the AND gate group 133, the output thereof is "0", and the content of the third channel of the envelope status counter 91 remains "1".

FIG. 13 shows the correspondence relation among the outputs of the calculation register (shift register) 120 and adder/subtracter 112, envelope data and envelope output. The first row in this table represents the results of the operation described above.

When the timing for the third channel after the aforementioned first calculation is reached, the second calculation is started on the basis of the data of "360" previously coupled to the shift register 120. The output of the subtracter 122 for the second calculation, provided from the subtracter 122, is "338", and this data "338" is coupled to the input terminal C of the subtracter 112 and to the input terminals of the shift register 120. Data of "127" is coupled again to the input terminal D of the adder/subtracter 112, whereby the subtraction (C−D) is executed. The resultant output is "211" as shown in FIG. 13, and this data "211" is inverted through the exclusive OR gate group 111 to "44", and also the envelope data becomes "44". The envelope output becomes "2".

Subsequently, the third and following calculations are executed in the manner as described above at every timing for the third channel. As a result, both the envelope data and envelope output are progressively increased in the manner as shown in FIG. 13. Since the envelope output is a 4-bit data, the envelope output data of "15" obtained after the 16th calculation represents the maximum value. Further, when the 18th calculation is executed, the output (A−B) of the subtracter 122 is "125", and thus the output (C−D) of the adder/subtracter 112 is "2". As a result, a borrow signal (of "1") is provided from the carrying/borrow output terminal CARRY/BORROW and coupled to the AND gate 109. Thus, an output of "1" is provided from the AND gate 109 to the OR gate group 131, thus causing the OR gate group 130 to forcibly provide data of "1" (all bits being "1") which serves as a data of 255". In other words, as the result of the 18th calculation, the envelope data becomes the maximum value of "255", while the envelope output is held as the maximum value "15" as the result of the 16th and 17th calculations. Further, the aforementioned data of "255", provided from the OR gate group 130 with all the bits thereof being "1", is given to the AND gate group 110 to enable this AND gate group 110. As a result, the output of the AND gate group 110 becomes "1" only at the time when the aforementioned envelope data takes the maximum value of "255" and is supplied to both the OR gate 99 and inverter 135 at the same time. The aforementioned signal of "1" coupled to the OR gate 99 is further coupled through the OR gate 100 and the AND gates 101 and 102, which are enabled at the timing for the third channel, to the second bit of the shift register 92. At the same time, an output of "0" from the AND gate 95, which is disabled by the output of "0" from the inverter 135, is coupled through the AND gate 96 and OR gates 97 and 98 to the first bit of the shift register 92. As a result, the content of the third channel of the shift register 92 is changed to "2", indicating the decay or sustain period of the third channel, and a signal of "1" is provided from the output terminal "2" of the decoder 94 at every timing for the third channel.

Meanwhile, by the output of "1" from the AND gate group 110, the switching gate group 124 is temporarily disabled, and also the switching gate group 130 is disabled at the same time. Further, at this time the switching gate groups 108 and 121 are disabled while the switching gate group 125 is enabled. As a result, the output of the inverter group 129, i.e., a data of "55" which is inverse to the sustain level SUS (which is now shown by numerical value data "200"), is provided through the switching gate group 130 to be coupled through the switching gate group 125 to the first stage register of the shift register 120, whereupon the calculation for the decay period of the third channel is started.

While the first calculation for the decay period is executed with respect to the aforementioned data "55", at this time the data "55" is coupled to the input terminal A of the subtracter 122, while data of "3" is coupled to the input terminal B. As a result, the output (A−B) of the adder/subtracter 112 is coupled to the input terminal C of the adder/subtracter 112. Meanwhile, to the input terminal D of the adder/subtracter 112 is coupled the data "200" of the sustain level S05 mentioned above through the switching gate group 117, which is held enabled during the decay and also sustain periods. During these decay and sustain periods, the switching gate groups 113 and 116 are both held disabled. Also, the switching gate group 108 and 121 are both held disabled, while the switching gate groups 124 and 125 are both held enabled.

During the decay and sustain periods, a signal of "0" is coupled as an addition instruction to the subtract instruction input terminal (−) of the adder/subtracter 112. Thus, in the first calculation in the decay period, the adder/subtracter 112 executes the addition of the data "52" and "200" coupled to the input terminals C and D. Meanwhile, a signal of "0" is coupled to the other input terminal of the exclusive OR gate group 111 during the decay and sustain periods, and thus the aforementioned data "252" is coupled without inversion through the exclusive OR gate group 111 to the OR gate group 131. Thus, the envelope data and envelope output obtained as the result of the first calculation are respectively "252" and "15". FIG. 14 shows the relationship among the inputs to the calculation register (shift register) 120 and adder/subtracter 112, envelope data and envelope output, and the first row in this table represents the result of the first calculation in the decay period.

The calculation result output data "52" of the first calculation, provided from the subtracter 122, is fed back through the switching gate groups 124 and 125 to the first stage register of the shift register 120. The result of the second calculation is as shown in the second row in the table of FIGS. 15A and 15B, and the third calculation is executed with respect to the data "49" which is fed back to the shift register 120. Likewise, the fourth and following calculations are executed at every timing for the third channel. In the above operation, the envelope output data is progressively reduced from "15" to "14" and thence to "13". Concurrently, the input data to the shift register 120 is progressively reduced. When the input data to the shift register 120 becomes "15" as the result of the 26th calculation, the shift circuit 123 provides an output of "0" for the next, i.e., 27th, calculation. Thus, the subtracter 122 provides "15" as the subtraction result output (A−B). As a result, the envelope data becomes "215", the envelope output becomes "13", and the input data to the shift register 120 again becomes "15". This means that the results of the 28th and following calculations are entirely the same as the result of the 27th calculation, that is, the input data to the shift register 120 is fixed to "15" and the envelope output to "13". In other words, the sustain period sets with the 28th calculation. This sustain period is continued until the aforementioned key is released.

When the key is released, a one-shot key-off pulse (one-bit time pulse) is produced from the keyboard, and it is coupled to the AND gate 107 at the timing for the third channel. Since the other input to the AND gate 107, i.e., the output of the AND gate 107, is "1", with the appearance of the key-off signal the output of the AND gate 107 becomes "1", which is coupled through the OR gate 98 to the first bit of the shift register 92. Meanwhile, data of "1" which has been held as such is fed back to the second bit of the shift register 92, the content of the third channel is changed to "3", indicating the release period. Also, as the third channel output of the decoder 94, a signal of "1" is provided only from the output terminal "3" from the next timing for the third channel. Further, the third channel content "3" is held circulated through the envelope status counter 91 until the third channel becomes a vacant channel. Further, with the output of "1" from the AND gate 107, the switching gate group 108 is held enabled only in the presence of the key-off signal, while during this period the switching gate group 125 is temporarily held disabled. Thus, the envelope data of "215" at the key-off instant is coupled through the switching gate group 108 to the first stage register of the shift register 120. Subsequently, the switching gate group 108 is disabled, and during the release period the switching gate groups 105, 116, 124 and 125 are held enabled while the switching gate groups 113, 117 and 121 are held disabled. In this state, the first calculation in the release period is executed with respect to the data "215" coupled to the shift register 120. In this case, since the switching gate group 116 is held enabled and the switching gate groups 113 and 117 are held disabled as mentioned earlier, a signal of "0" (all bits being "0") is coupled to the input terminal D of the adder/subtracter 112 at every timing for the third channel. Further, the addition instruction is given to the adder/subtracter 112, and further an output of "0" is coupled from the output terminal "1" of the decoder 94 to the exclusive OR gate group 111. Thus, during the release period the addition output (C+D) of the adder/subtracter 112 is directly provided as the envelope data from the OR gate group 131. Since the input data to the input terminal D is "0" at this time, the envelope data mentioned above is the same as the subtraction output data (A−B) from the subtracter 122 at this time.

When the first calculation in the release period is executed, the envelope data becomes "202", while the envelope output becomes "12". Further, a data of "202" is coupled to the first stage register of the shift register 120. Thus, the second calculation is executed with respect to the data "202" at the next timing for the third channel. FIGS. 15A and 15B show the results of calculations during the release period described above. As is shown, the envelope output is progressively reduced from the value "13" at the time of the start of the release period. As a result of the 49th calculation, the envelope data becomes "15", which is coupled to the first stage register of the shift register 120. Thus, the envelope output is changed to "0". The envelope output of "0" (corresponding to a binary number "0000") at this time is coupled to the inverter group 132, whereupon the output of each inverter in the inverter group 132 is changed to "1" to change the output of the AND gate group 133 to "1" which is coupled to the AND gate 118. Meanwhile, since the other input to the AND gate 118 is "1", the output thereof is changed to "1" to change the output of the inverter 134 to "0" so as to disabled the AND gates 96 and 101 at the same time. Thus, signals of "0" and "0" are simultaneously coupled to the first and second bits of the shift register 92, thus rendering the content of the third channel of the envelope status counter 91 to "0". Further, a signal of "1" is provided only from the output terminal "0" of the decoder 94 from the next timing for the third channel, whereby the third channel is rendered to be a vacant channel to be ready for assignment. At the same time, the operation of envelope formation in the third channel of the envelope generator is stopped, thus stopping the sound production.

Figure 16:
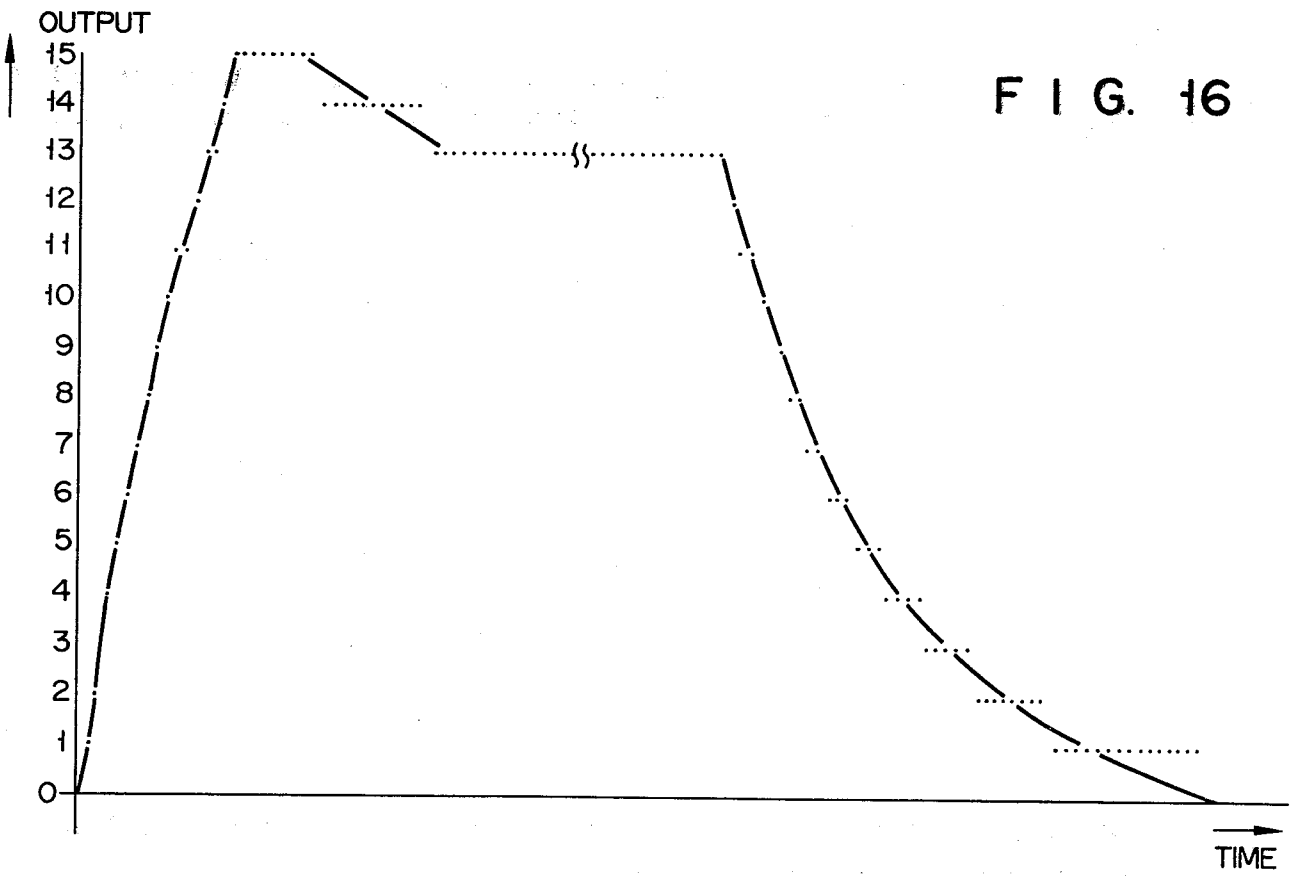
FIG. 16 is a graph showing an example of the envelope obtained with the envelope generator of FIG. 12.

FIG. 16 shows the operation described above on the basis of FIGS. 13, 15A and 15B. While in the instant embodiment the same value is consecutively provided as the envelope output for the envelope output is a 4-bit data which is set as such in conformity to the construction of the shift circuit 123, the formation of musical sound according to the envelope waveform of FIG. 16 gives rise to no problem in the musical point of view. Of course, a more ideal envelope waveform such as shown by the solid curve in FIG. 16 can be readily obtained by increasing the number of bits of the envelope output.

Figure 17A:
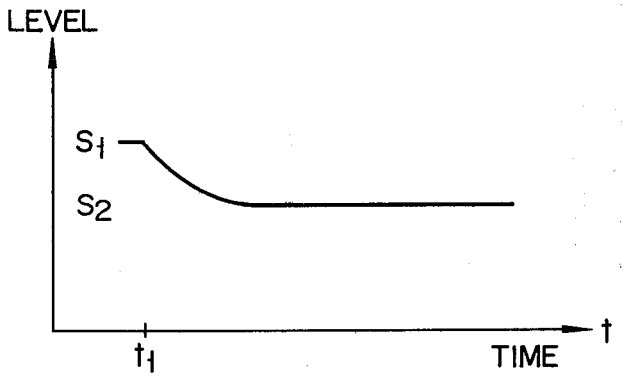
FIG. 17A is a graph showing a follow-up character of changes of the envelope output with respect to changes of the sustain level obtained in the envelope control with a prior art analog circuit.
Figure 17B:
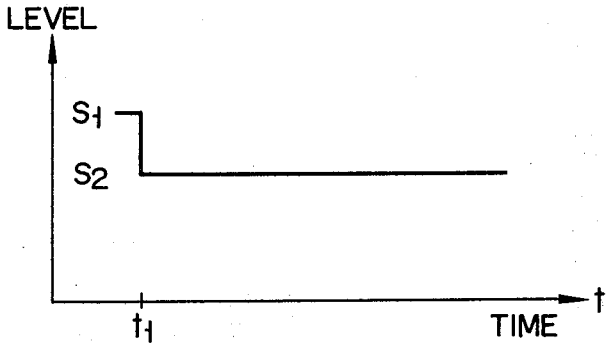
FIG. 17B is a graph showing a follow-up character of changes of the envelope output with respect to the sustain level changes obtained with the embodiment of FIG. 12.

Further, with this embodiment, in which during the aforementioned decay and sustain periods the data of the sustain level SUS is coupled to the input terminal D of the adder/subtracter 112 and the addition output (C+D) thereof is directly provided as the envelope data while using the upper four bits thereof as the envelope output, in case when the sustain level is changed during the decay or sustain period by operating the sustain lever, for instance when the sustain level SUS is reduced from $S_1$ to $S_2$ at an instant $t_1$ as shown in FIG. 17B, the envelope output is also reduced by the corresponding amount immediately after the instant $t_1$, that is, a system which has a very superior follow-up characteristic compared to the operation of a prior art system as shown in FIG. 17A can be obtained.

Further, when the key is released during the attack period of the envelope with the above embodiment, the output of the AND gate 107 is changed to "1" in the same manner as described above in connection with the key-off instant, thus changing the content of the third channel of the envelope status counter 91 from "1" indicative of the attack period to "3" to bring about the release period. At the key-off instant, the envelope data is coupled through the switching gate group 108 to the shift register 120. As a result, the calculation of the release period is started on the basis of the aforementioned envelope data at the key-off instant. Of course, with the change of the envelope data to "0" the relevant channel, the third channel in the above case, is rendered to be a vacant channel. Likewise, with the release of the key during the decay period of the envelope, the release period of the third channel immediately sets in, while at the same time the envelope data at the key-off instant is coupled to the shift register 120 to start the calculation for the release period. Further, when the release period is ended, a vacant channel is recovered.

While in the preceding embodiment the value of 1/16 time the input data to the shift circuit 123 has been calculated through the shift of the input data by four bits to the right, the attack, decay and release periods, i.e., the corresponding slopes of the exponential function curve, can be controlled by such means as varying the number of bits of shifting according to the operation of the individual control levers.

Further, in such a case, the initial value supplied through the switching gate group 121 and the value of data supplied through the switching gate group 113

(which is "127" in the preceding embodiment) may be changed to various values if necessary.

Further, the bit number of the envelope output can be increased from the 4 bits by providing additional bits for the calculation processing.

Further, while in the preceding embodiment the exponential function waveform calculation mentioned above has been carried out using an equation $$A_n = A_{n-1} - \frac{A_{n-1}}{\alpha} = \left(1 - \frac{1}{\alpha}\right)^n A_0$$

where n is an integer, $\alpha$ is a positive number and $A_0$ is an initial value, this equation can be modified in various ways, and the calculation circuit can also be modified accordingly.

Further, while the preceding embodiment can be used for the control of the sound volume envelope of an electronic organ, it can also be used for the control of the oscillation frequency, filter cut-off frequency, sound volume, etc. in music synthesizers. Also, it can be used for various envelope controls of various electronic musical instruments.

Yet further, a higher degree of approximation to the ideal envelope waveform can be obtained in forming the envelope curve by using an equation $$A_n = A_{n-1} - \frac{A_{n-1}}{\alpha}$$

in lieu of the aforementioned equation $$A_n = A_{n-1} - \frac{A_{n-1} - \gamma}{\alpha} \quad (2)$$

for the exponential function waveform calculation. A second embodiment of the invention which is to be described hereinafter is based upon the equation (2), and also in which the rate of change of the envelope is made variable by making the clock variable. The variable clock generator used in this second embodiment will first be described with reference to FIG. 18.

Figure 18:
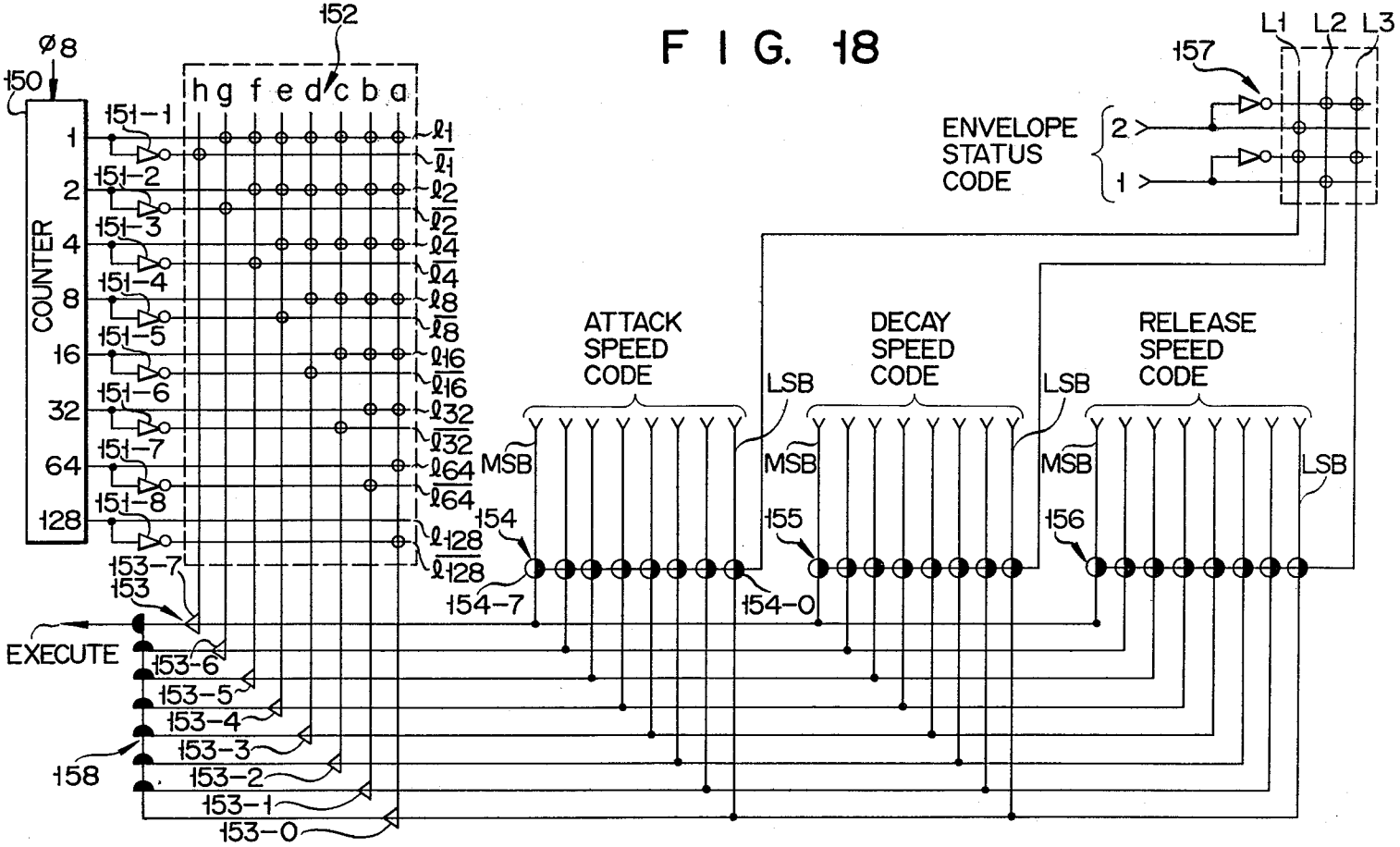
FIG. 18 is a schematic showing a variable clock generator which is used in relation to a further example of the envelope generator.

In FIG. 18, a binary counter 150, which has an 8-bit construction, executes counting operation under the control of a clock signal $\phi_8$. This clock signal $\phi_8$ has a frequency equal to eight times a system clock signal $\phi_0$ which is utilized in an ADSR envelope generator 11*b* or the like. The count data provided from the individual bits of the binary counter 150 (with the weighting of "1", "2", "4", "8", "16", "32", "64" and "128" for the respective bits) are respectively coupled directly to row lines $l_1$ to $l_{128}$ of a NOR type ROM 152 and also coupled through inverters 151-1 to 151-8 to row lines $l_1$ to $l_{128}$ of the NOR type ROM.

Figure 24A:
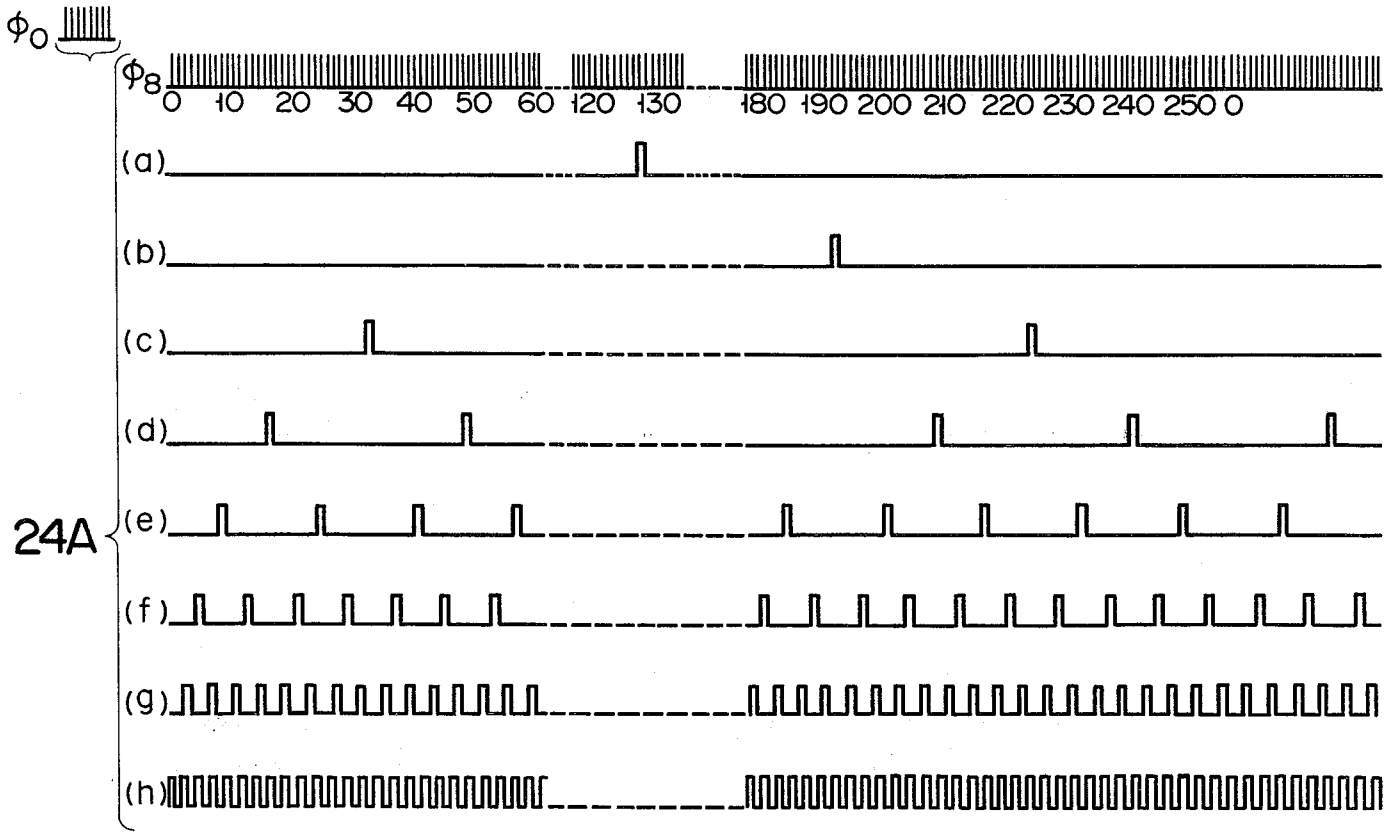
FIGS. 24A and 24B constitute a timing chart for illustrating the operation of the variable clock generator shown in FIG. 18.

The NOR type ROM 152 is a ROM (Read Only Memory) constituted by NOR gates shown as circles in the Figure, and it has a function of a decoder. It supplies from its column lines a to h as output lines respective clock signals which are coupled as gate control signals to corresponding AND gates in an AND gate group 153. From the column line a of the NOR type ROM 152, a single clock pulse is provided in one counting cycle of the binary counter 150 when the count content thereof becomes "128" (see FIG. 24A). From the column line b, two clock pulses are provided in one counting cycle respectively when the count content is "64" and "192". Similarly, from the row lines c, d, e, f, g and h, 4, 8, 16, 32, 64 and 128 clock pulses are respectively provided in one counting cycle at timings (count content values) as shown in FIG. 24A. It is to be understood that the NOR type ROM 152 is constructed in one counting cycle of the binary counter 150, no simultaneous clock pulses, i.e., clock pulses of the same timing, are provided from one of the row lines a to h.

An attack speed code, a decay speed code and a release speed code, all these codes being 8-bit data, are supplied to respective switching gate groups 154 to 156 each consisting of eight switching gates. The switching gate groups 154 to 156 are controlled for gating by respective output signals from output lines 1 to 3 of a decoder 157.

To the decoder 157, an envelope status code from an envelope status counter to be described later, provided in the ADSR envelope generator 11*b*, is supplied. The content of this envelope status code is "1" during the attack period of envelope, "2" during the decay and sustain periods and "3" during the release period. A signal of "1" is provided from an output line L1 when the content of the envelope status code is "1", from an output line L2 when the content is "2" and from an output line L3 when the content is "3". These "1" signals enable the corresponding switching gate groups 154 to 156.

The outputs of the individual switching gates of the switching gate groups 154 to 156 are coupled to the corresponding AND gates 153-7, 153-6,–, 153-0 of the AND gate group 153. The outputs of the individual AND gates of the AND gate group 153 are coupled to an OR gate group 158, to provide a variable clock execute signal EXECUTE.

Figure 24B:
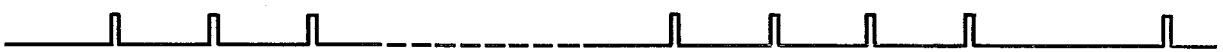

With the variable clock generator of the above construction, if the attack speed code is set to, for instance, "00001111", during the attack period of envelope the switching gates 154-0 to 154-3 of the switching gate group 154 provide outputs of "1" while the other switching gates 154-4 to 154-7 of the group provide outputs of "0". In accordance with these outputs, the clock signal outputs from the row lines a to d of the NOR type ROM 152 are coupled through the AND gates 153-0 to 153-3 of the AND gate group 153 to the OR gate group 158 and ORed therein for each counting cycle period of the binary counter 150. Thus, a variable clock execute signal EXECUTE, consisting of 15 pulses in one cycle period as shown in FIG. 24B, is obtained.

It is to be understood that for providing the slowest attack speed, the attack speed code may be set to "00000001". By so doing, for each cycle period of the binary counter 150 the clock signal from the row line a of the NOR type ROM 150 is coupled through the AND gate 153-0 to the OR gate group 158, and a variable clock execute signal EXECUTE consisting of a single pulse in one cycle period is obtained.

For providing the highest attack speed, the attack code is set to "11111111". By so doing, all the clock signals from the row lines a to h are coupled through the AND gate group 153 to the OR gate group 158, and thus a variable clock execute signal EXECUTE consisting of 255 pulses in one cycle period is obtained. In this way, the attack speed can be increased in proportion to the content of the attack speed code. Entirely the same thing can apply to the decay and release speed codes, that is, the decay and release speeds can be adjusted to any desired speeds as the variable clock execute signal EXECUTE can be varied according to the setting of the decay and release speed codes.

Figure 19A:
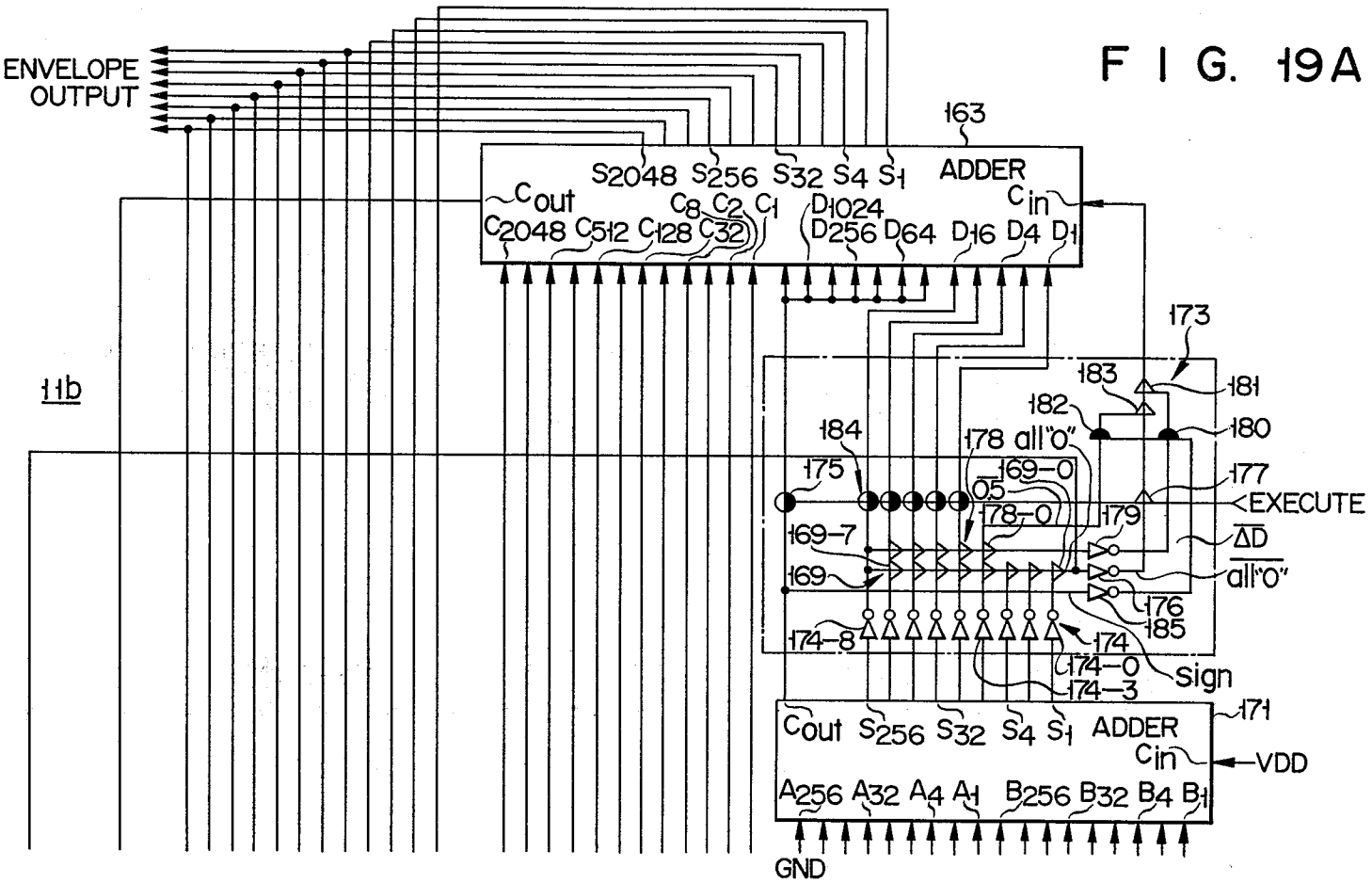
FIGS. 19A and 19B are schematics showing examples of the generator that may be used together with the variable clock generator of FIG. 18.

The ADSR envelope generator 11b as mentioned above will now be described with reference to FIGS. 19A and 19B. In these Figures and FIGS. 12A and 12B, like parts are designated by like reference symbols. The output of the output terminal "1" of decoder 94 is supplied as gate control signal to an AND gate 161 and switching gate group 162. To the AND gate 161 a carry output signal from a carry output terminal $C_{out}$ of an adder 163 to be described later is also coupled, and the output of the AND gate 161 is coupled through the inverter 135, AND gates 95 and 96 and OR gates 97 and 98 to the lower bit of the shift register 92 and also coupled through the OR gate 100 and AND gates 101 and 102 to the upper bit of the shift register 92. The output of the AND gate 161 is further coupled as gate control signal directly to a switching gate group 164 and also through an inverter 166 to a switching gate group 165.

The output from the output terminal "2" is supplied as gate control signal to a switching gate group 167.

The output from the output terminal "3" is supplied as gate control signal to an AND gate 118 and a switching gate group 168. To the AND gate 118 a signal all "0" provided from an AND gate group 169 to be described later is coupled, and the output of the AND gate 118 is coupled through inverter 134, AND gate 96 and OR gates 97 and 98 to the lower bit of the shift register 92 and also coupled through an inverter 134 and AND gates 101 and 102 to the upper bit of the shift register 92.

A shift register 170, which has eight 12-bit shift registers connected in cascade, has its output side connected to the aforementioned adder 163, and the calculation result data thereof (i.e., 12-bit envelope data) is fed back through a switching gate group 165 which is normally held enabled to the shift register 170 at times other than the instant of end of the attack period for the operated key. The calculation result data fed back to the shift register 170 is shifted therethrough and provided from the eighth stage thereof to be coupled to C input terminals $C_{2048}$, $C_{1024}$,–, $C_1$ of the adder 162. The upper eight bits of the calculation result data are also coupled to A input terminals $A_{256}$, $A_{128}$,–, $A_1$ of an adder 171. A signal of "0", at ground level GND, is coupled to the A input terminal $A_{256}$ of the adder 171.

Further, at the instant of the end of the attack period for an operated key, the switching gate 165 is temporarily held disabled while the switching gate group 164 is enabled, whereupon the switching gate group 164 supplies data of "1" (all bits being "1") to the first stage of the shift register 170 for writing therein.

To B input terminals $B_{256}$, $B_{128}$,–, $B_1$ of the adder 171, the 9-bit data output of an inverter group 172 is coupled, while a signal of "1" is always supplied to a carry input terminal $C_{in}$ of the adder 171. During the attack period for an operated key, data "101111111" from the switching gate group 162 which is held enabled during the aforementioned attack period is coupled to the inverter group 172. Thus, during the attack period, the adder 171 performs the addition (A – B) of the data coupled to its A input terminals and the data that is obtained after inversion of the individual bits of the aforementioned data "101111111" through the inverter group 172 followed by the addition of "+1" to the result, i.e., data inverse in symbol to the data coupled to the B input terminals (or data "010000001" in the expression of a complement of 2), and supplies the resultant sum data from its S output terminals $S_{256}$, $S_{128}$,–, $S_1$ as 9-bit data to a compensation circuit 173.

During the decay and sustain periods after the attack period, the sustain level data is coupled through a switching gate group 167, which is held enabled during the decay and sustain periods, to the inverter group 172 mentioned above. Thus, during the decay and sustain periods, the adder 171 adds the data input to its A input terminals and data of the sustain level in the complement-to-2 form and supplies the result data to the compensation circuit 173.

Further, during the release period, from the switching gate group 168 which is held enabled during the release period, data of "0" (all bits being "0") is supplied to the inverter group 172. Thus, during the release period the adder 171 adds the data input to the A input terminals and data of "0" for all eight bits in the complement-to-2 form (which is no other than all bits being "0") and supplies the result data to the compensation circuit 173.

The compensation circuit 173 is provided for obtaining exact execution of the waveform calculation of the exponential function equation (2) mentioned above.

This will be discussed in further detail. The 9-bit result data from the adder 171 is supplied to an inverter group 174. Also, a carry output signal from a carry output terminal $C_{out}$ of the adder 171 is coupled through a switching gate 175 to D input terminals $D_{2048}$, $D_{1024}$,–, $D_{32}$ of the adder 163. The output of the inverter group 174 is coupled to the AND gate group 169 mentioned above. A signal obtained from the AND gate 169-0 is referred to as signal all "0", and a signal obtained through the inversion of this signal all "0" through an inverter 176 is referred to as a signal $\overline{\text{all "0"}}$. The signal all "0" is "1" when all the result data bits from the A output terminals of the adder 171 are all "0" and is otherwise "0". This signal all "0" is coupled to the AND gate 118 as mentioned earlier, while the signal $\overline{\text{all "0"}}$ is coupled to an AND gate 177. The outputs of the inverters 174-8, 174-7,–, 174-3 of the inverter group 174 are coupled to an AND gate group 178. A signal obtained through the invention of the output of the AND gate 178-0 through an inverter 179 is referred to as $\overline{\Delta D}$. The signal is $\overline{\Delta D}$ is "0" when the upper six bits of the result data of the adder 171 are all "0" and is otherwise "1". It is coupled as a gate control signal through an OR gate 180 to an AND gate 181. The outputs of the inverters 174-8, 174-7,–, 174-4 are also coupled to a switching gate group 184. The switching gate group 184 and the aforementioned switching gate 185 are controlled for gating by the variable clock execute signal EXECUTE. The outputs of the switching gate group 184 are supplied to the D input terminals $D_{16}$, $D_8$,–, $D_1$ of the adder 163. To the D input terminals of the adder 163, the carry output signal of the adder 171 and the upper five bits of the result data of the adder 171 are supplied with the appearance of each variable clock execute signal EXECUTE. The output of the inverter 174-3 of the inverter group 174, which is referred to as signal $\overline{0.5}$, is coupled as a gate control signal through an OR gate 182 to an AND gate 183. This signal $\overline{0.5}$ is "1" when the data of the 4th bit from the lowest bit of the result data of the adder 171 (i.e., the output of the S output terminal S8) is "1" and is "1" when this data is "0". The carry output signal of the adder 171 is also referred to as Sign and is coupled through an inverter 185 to the OR gates 180 and 182 to provide gate control signals for the AND gates 181 and 183. This signal Sign is "0" during the "up" slope period of the envelope and is "1" during the "down" slope period of the envelope. The AND gate 177, which receives the aforementioned signal $\overline{\text{all "0"}}$ as an input signal, is controlled for gating by the variable clock execute signal EXECUTE, and its output is coupled to the AND gate 183, the output of which is in turn coupled to the AND gate 181, which supplies its output to the carry input terminal $C_{in}$ of the adder 163.

With the above construction of the compensation circuit 173, the waveform calculation is executed through the control of the input data to the D input terminals and carry input terminal $C_{in}$ of the adder 163 such that during the attack period for the operated key a signal of "1" is supplied to the carry input terminal $C_{in}$ so that the result data (C+D) of the adder 163 is incremented by "+1" for each calculation, that during the decay, sustain and release periods, i.e., the "down" slope period, whether the correction of rounding of the lower four bits to the D input terminals $D_8$, $D_4$,–, $D_1$ is executed is controlled in terms of whether a signal of "1" is impressed upon the carry input terminal $C_{in}$ and that when the upper six bits of the adder 171 all become "0" in the aforementioned "down" slope period, a signal of "0" is supplied to the carry input terminal $C_{in}$ of the adder 163 so that the result data of the adder 163 is progressively incremented by "−1" so as to bring the "down" slope period to an end. Of the aforementioned envelope data having the 12-bit configuration, the upper eight bits are supplied as the envelope output to the musical sound producing circuit for effecting the provision of the envelope to the musical sound generated in that circuit.

Now, the operation of this embodiment will be described. Before the start of performance with the electronic musical instrument, the attack, decay, sustain and release levers are set to respective desired positions. With this setting, the variable clock signal generator generates a variable clock execute signal EXECUTE having the corresponding content, which is supplied to the ADSR envelope generator 11*b*.

Now, the operation of the variable clock signal generator will be described in detail. The binary counter 150 is always counting the clock signal $\phi_8$, and its count data is supplied to the row lines $l_1$, $\overline{l_1}$, $l_2$, $\overline{l_2}$,··,$l_{128}$, $\overline{l_{128}}$. The NOR type ROM 152 decodes the count data mentioned above and supplies the clock signals as shown in FIG. 24A from its row lines a to h to the AND gate group 153 for each counting cycle period of the binary counter 150. The clock signals from the row lines a to h are provided at different timings, that is, none of the clock signals are provided at the same timing.

Figure 19B:
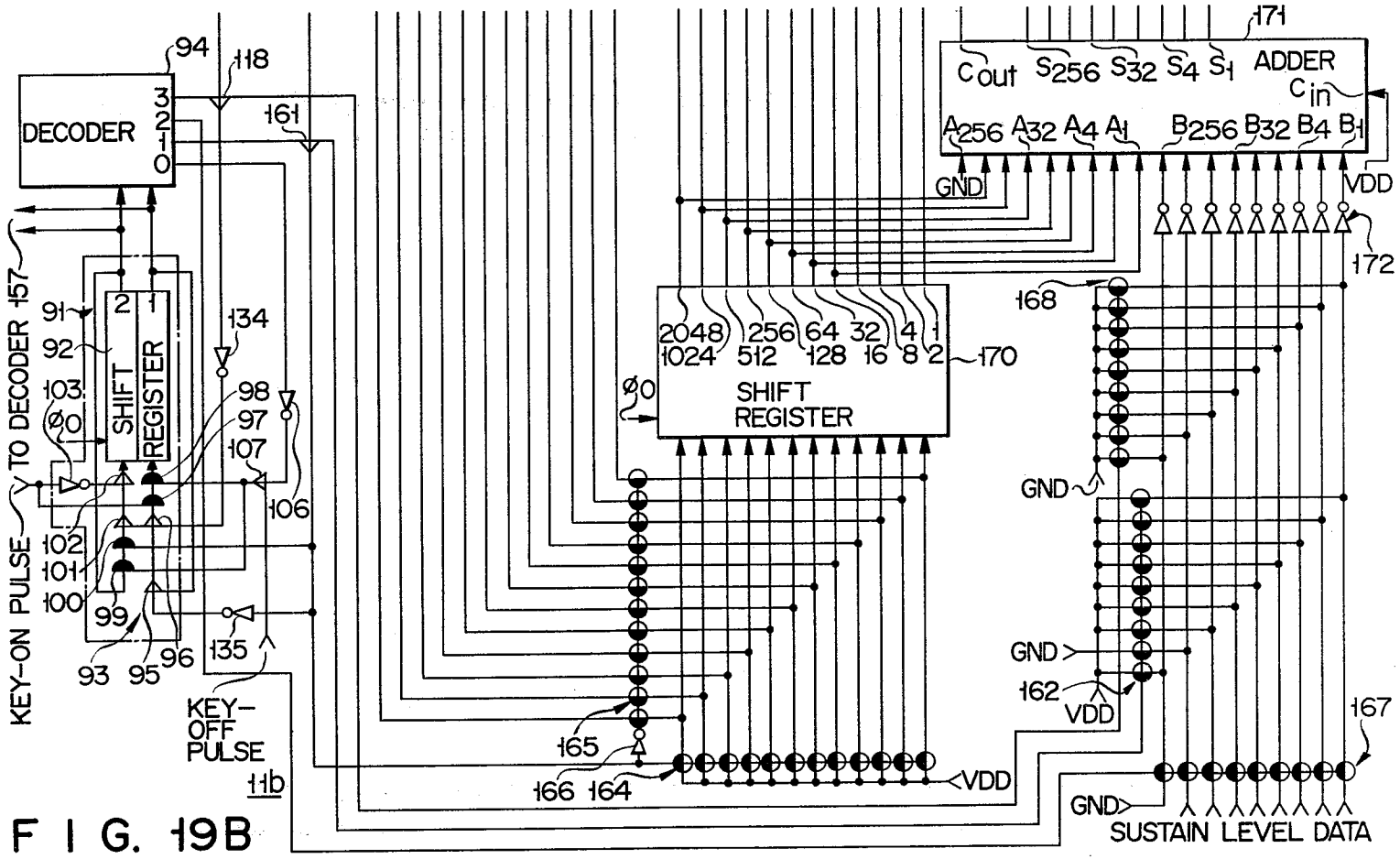

Meanwhile, if the attack lever is set to a position such that the content of the attack speed code is "00001111", during the attack period a signal of "1" is provided from the output line L1 of the decoder 157 to enable the switching gate group 154 at every timing, at which the data indicative of the attack period, i.e., envelope status code of the content "01" (in the binary expression), is provided from the shift register 92 shown in FIG. 19B. Thus, at that every timing an attack speed code "00001111" is provided from the switching gate group 154 to the AND gate group 153, whereby at that every timing the AND gates 153-0 to 153-3 are enabled while the AND gates 153-4 to 153-7 are disabled. If this timing corresponds to the timing at which the clock is generated from, for instance, the row line a (i.e., for which the count data content of the binary counter 150 is "128"), this clock signal is coupled through the AND gate 153 to the OR gate group 158. As a result, a one-shot variable clock execute signal EXECUTE is generated.

Likewise, at the timing at which the clock signals from the row lines b, c and d are generated, the clock signals are provided as the variable clock execute signal EXECUTE from the AND gates 153-1, 153-2 and 153-3. At the timings at which the clock signals are generated from the row lines e to h, no variable clock execute signal EXECUTE is generated since the AND gates 153-4 to 153-7 are held disabled at this time.

In the above way, when the attack speed code is "00001111", for each counting cycle period of the binary counter 150 a total of 15 variable clock execute signal pulses EXECUTE are generated. These clock pulses are provided as the result of ORing the clock signals from the row lines a to d of the NOR type ROM 152. The variable clock execute signal EXECUTE that is obtained in the above way is supplied to the ADSR envelope generator 11*b*, which thus executes the waveform calculation for the attack status section of the envelope for the operated key every time a variable clock execute signal EXECUTE is provided. In the instant case, a medium speed is set for the waveform formation for the attack status section.

The operation of generation of the variable clock execute signal EXECUTE during the decay and release periods is the same as that during the attack period. More particularly, during the decay period, an envelope status code of a content of "10" is supplied to the decoder 157, and a signal of "1" is provided from the output line L2 to enable the switching gate group 155. At this timing, the decay speed code is coupled through the switching gate group 155 to the AND gate group 153. Thus, a clock signal is provided as the variable clock execute signal EXECUTE from an AND gate, if any, to which the clock signal provided from the NOR type ROM 152 at the aforementioned timing and a signal of "1" specified by the decay speed code are coupled.

During the release period, an envelope status code of a content of "11" is supplied to the decoder 157. As a result, a signal of "1" is provided from the output line L3, while the release speed code is provided from the switching gate group 156. Thus, a state capable of generating the variable clock execute signal EXECUTE is brought about in the manner as described above.

At the timing at which the content of the envelope status code is "00" indicative of a vacant channel, the generation of the variable clock execute signal EXECUTE is inhibited, and thus the waveform calculation in the ADSR envelope generator is impossible.

Now, the operation of the ADSR envelope generator 11*b* will be described in detail. It is assumed that the sustain lever is set such that the sustain level data is "126" (corresponding to "01111110" in the binary expression). The case when a certain channel in FIGS. 19A and 19B is a vacant channel will first be taken. In this case, the count of the envelope status counter 91 with respect to that vacant channel, i.e., the content of the shift register 92 with respect to that vacant channel, is "0". Thus, this content "0" is provided from the shift register 92 at the timing for that vacant channel, and every time it is provided to the decoder 94 a signal of "1" is provided from the output terminal "0" of the decoder 94. This "1" signal is inverted by the inverter 106 to "0" which is coupled to the AND gate 107 to change the output thereof to "0". This "0" signal from the AND gate 107 is coupled to the OR gates 98 and 99, and since the other input to the OR gate 98, i.e., the output of the OR gate 97, is "0" at this time, an output of "0" is provided from the OR gate 98 to the first bit of the first stage register of the shift register 92. At the same time, an output of "0" from the AND gate 102 is provided to the second bit of the aforementioned first stage register. This means that the data of "0" is supplied again to the shift register 92 at the timing for the aforementioned vacant channel, and subsequently the operation as described above is repeatedly executed with respect to the aforementioned vacant channel.

Meanwhile, at the timing for the aforementioned vacant channel, at which time the outputs from the output terminals "1", "2" and "3" of the decoder 94 are all "0", only the switching gate group 165 is enabled while the switching gate groups 162, 164, 167 and 168 are held disabled. The shift register 170 thus provides data of "0" (all bits being "0") as the envelope data to the A input terminals of the adder 171 and also to the C input terminals of the adder 163.

At the same time, the inverter group 172, to which the data of all bits being "0" is coupled, provide output of all data being "0" which is coupled to the B input terminals of the adder 171. Further, since a signal of "1" is always supplied to the carry input terminal $C_{in}$ of the adder 171, the output data from the S output terminals of the adder 171 are all "0" while the carry output is "1". The upper five bits of the output data from the S output terminals of the adder 171 are inverted through the inverter group 174 to "1" for all bits for coupling to the switching gate group 184, while at the same time the aforementioned carry output "1" is coupled to the switching gate 175. Since the generation of variable clock execute signal EXECUTE at the timing for the aforementioned vacant channel is inhibited, at this timing the outputs of the switching gate group 184 and switching gate 175 are both "0", and thus data of all bits "0" are coupled to the D input terminals of the adder 163. Further, since the input to the carry input terminal $C_{in}$ of the adder 163 is "0", the result data from the S output terminals of the adder 163 are all bits "0" data, which are fed back through the switching gate group 165 in the enabled state to the shift register 170. As the operation described above is repeated, the envelope data with all bits being "0" in the register for the aforementioned vacant channel in the shift register 170 is held circulated. Also, the envelope output is provided with all bits being "0". Thus, no musical sound producing operation for the aforementioned vacant channel is effected.

When a key is depressed in the presence of a vacant channel as mentioned above, the key-on operation is detected, and a key-on pulse is generated as a one-bit timing pulse from the keyboard 12 and supplied to the ADSR envelope generator 11*b*. The key-on pulse (of "1") is coupled through the OR gates 97 and 98 to the first bit of the first stage register of the shift register 92 at the timing for, for instance, the third channel.

At the same time, the output of the inverter 103, which output is changed to "0" with the appearance of the key-on pulse (of "1"), is coupled through the AND gate 102 to the second bit of the aforementioned first stage register. As a result, the content of the third channel of the shift register 92 is changed to "1", indicating that the vacant channel period of the third channel is changed to the attack period. The data showing this content "1" for the third channel is provided from the shift register 92 to the decoder 94 for decoding therein, whereby the output of only the output terminal "1" is changed to "1" at the timing for the third channel.

Of the data of "1" for the third channel, provided from the shift register 92, the first bit data "1" is coupled through the AND gates 95 and 96, which are enabled at the timing of that output, and also through the OR gates 97 and 98 to the first bit of the first stage register of the shift register 92, while at the same time the second bit data "0" is coupled through the OR gates 99 and 100, the other input to which is "0" at this time, and the AND gates 101 and 102 to the second bit of the aforementioned first stage register. As a result, the aforementioned data of "1" is coupled again to the shift register 92 at the timing for the third channel, and subsequently it is held circulated through the circulating circuit mentioned above during the attack period of the third channel. Also, a signal of "1" is provided from the output terminal "1" of the decoder 94 at the timing for the third channel.

As the signal of "1" appears from the output terminal "1" of the decoder 94 at every timing for the third channel after the appearance of the key-on pulse for that channel, the switching gate group 162 is enabled by this "1" signal, thus permitting data "101111111" (corresponding to "383" in the decimal expression) to be coupled through the switching gate group 162 to the inverter group 172 for inversion for all the bits and then coupled to the B input terminals of the adder 171. The data "101111111" mentioned above gives the final value of "383" for the waveform calculation performed according to the equation (2) mentioned above for the attack period.

The shift register 170 also supplies the output data with all bits being "0" to the A input terminals of the adder 171. The adder 171 thus adds the data of all bits "0" coupled to its A input terminals and the data in the complement-to-2 form coupled to the B input terminals and provide the result data from the S output terminals and carry output terminal $C_{out}$. The result data in this case is "010000001", while the carry output is "0". Thus, data "0" is coupled to the switching gate 175, and data "10111" obtained as the upper five bits of the result data are inverted through the inverter group 174 are coupled to the inverter group 174. Further, at this time signal Sign is "0", the signal $\overline{\text{all "0"}}$ is "1", the signal $\overline{\Delta D}$ is "1", and the signal $\overline{0.5}$ is "1".

When a first variable clock execute signal EXECUTE is generated in the aforementioned state after the start of the attack period for the third channel, data "000000010111" is coupled to the D input terminals of the adder 163, and data "1" is coupled to the carry input terminal $C_{in}$. Further, to the C input terminals data of "0" (all bits being "0") is coupled. Thus, the result data provided from the S output terminals of the adder 163 at this time is "000000011000". The envelope data thus provided is fed back through the switching gate group 165 in the enabled state to the shift register 170. Also, the upper eight bits of the envelope data, namely "00000001", are supplied to the musical sound forming circuit.

In the above way, the first waveform calculation in the attack period according to an equation $$A_n = A_{n-1} - \frac{A_{n-1} - 383}{256} \quad (3)$$

is executed.

When a time interval for eight bits has been elapsed from the end of the first waveform calculation mentioned above, the result data of the first calculation is supplied from the shift register 170 to the A input terminals of the adder 171 and also the C input terminals of the adder 163, whereupon it becomes ready for executing the second waveform calculation. That is, the second waveform calculation is executed as soon as a variable clock execute signal EXECUTE is provided in this state. However, the variable clock execute signals are generally not provided at the regular 8-bit time interval, but they are provided irregularly or non-cyclically at 8 times n (n being any positive integer) bit time. While the waveform calculation is executed with the appearance of the variable clock execute signal EXECUTE, during the period from the end of a waveform calculation until the start of the next calculation, the result data of the previous calculation is held circulated through the circulating circuit constituted by the shift register 170, adder 163 and switching gate group 165. Thus, until the next waveform calculation, the same data is repeatedly coupled to the adders 171 and 163 every time the timing for the third channel occurs at the 8-bit time interval.

During the attack period, the adder 171 executes the addition of the upper 8-bit portion of the envelope data coupled from the shift register 170 to the A input terminals and the complement-to-2 data of the data "383" coupled from the switching gate group 162 to the B input terminals. As for the result data obtained from the adder 171 during the attack period, however, since $\alpha$ and $\gamma$ in the equation (2) are selected to be respectively "256" and "383", the carry output is always "0", and thus the signal Sign is always "0". Also, during this period the signal all "0" is always "1". That is, during this period a signal of "1" is always supplied as "+1" instruction to the carry input terminal $C_{in}$ of the adder 163. The adder 163 thus adds the envelope data input to the C input terminals and the input data to the D input terminals (the upper seven bits of the input data being all "0") and increment the result by "+1".

FIG. 20 shows the result data of the calculations performed according to the equation (3) mentioned above during the attack period for each calculation, i.e., each step. As is shown in the Figure, the envelope output (i.e., the upper 8-bit output of the adder 163) progressively increases from "0" to "1", "3", "4", . . . up to the last value of "255".

When the upper 8-bit portion of the envelope data (i.e., envelope output) becomes "255" and then a carry signal (of "1") is provided from the carry output terminal $C_{out}$ of the adder 163 at the time of the next calculation, the output of the AND gate 161 goes to "1", which is coupled through the OR gate 100 and AND gates 101 and 102 to the second bit of the first stage register of the shift register 92 at the timing of the third channel. At the same time, the "1" output of the AND gate 161 is coupled through the inverter 135 to provide output of "0" so as to change the output of the AND gate 95 to "0" which is coupled to the first bit of the aforementioned first stage register. Thus, the content for the third channel is changed to "2", indicating the decay and sustain periods. Subsequently, a signal of "1" is provided only from the output terminal "2" of the decoder 94 at the timing for the third channel for enabling the switching gate group 167. Also, the content "2" for the third channel is held circulated through the shift register 92. Further, with the appearance of the "1" output from the AND gate 161, the output of the inverter 166 is temporarily held "0", thus disabling the switching gate group 165 while enabling the switching gate group 164. As a result, from the switching gate group 164 data of "1" for all bits is provided to be coupled to the shift register 170 at the timing for the third channel.

When the decay period of the third channel is brought about in the above way, the sustain level data having a content of "001111101" (corresponding to "126" in the decimal expression) is coupled through the switching gate group 167 to the inverter group 172 at every timing for the third channel. Thus, during the decay period the adder 171 performs the operation of adding the data to its A input terminals and the complement-to-2 data of the sustain level data coupled to the B input terminals. The sustain level data of "126" mentioned above provides the last value of $\gamma = 126$ for the waveform calculation according to the equation (2) during the decay period.

In the calculation in the adder 171 during the decay period, the input data to the A input terminals is always greater than the sustain level data, so that the carry output is always "1", that is, the signal Sign is always "1". Also, during this period the signal $\overline{\text{all "0"}}$ is "1". Thus, when the upper six bits of the result data of the adder 171 are not all "0" (i.e., the signal $\overline{\Delta D}$ is "1") while also the output of the S output terminal $S_8$ is "0" (i.e., the signal $\overline{0.5}$ is "1"), the AND gate 181 provides an output of "1", and thus a signal of "1" is impressed upon the carry input terminal $C_{in}$ of the adder 163. At this time, the adder 163 adds the data coupled from the shift register 170 to the C input terminals and the data to the D input terminals (the upper seven bits of the data being all "1") and increments "+1" to the result of addition. In this case, however, with the "1" signal coupled to the carry input terminal $C_{in}$, rounding is effected to increase the result of calculation by "1" (i.e., make it equal to the proper value).

When the upper 6-bit portion of the result data of the adder 171 is not "0" (the signal $\overline{\Delta D}$ is not "1") and the output of the S output terminal $S_8$ is "1" (signal $\overline{0.5}$ is "0"), the output of the AND gate 181 is "0", and a signal of "0" is coupled to the carry input signal $C_{in}$. As a result, in the adder 163 rounding is effected so as not to change the result of calculation (i.e., make it equal to the proper value incremented by "−1").

Further, when the upper six bits of the result data of the adder 171 become all "0" to change the signal $\overline{\Delta D}$ to "0", the output of the AND gate 181 is changed to "0" which is impressed upon the carry input terminal $C_{in}$ of the adder 163. Since at this time the data prevailing at the D input terminals of the adder 163 are all "1", the result data of the adder 163 is equal to what is obtained by incrementing the input data to the C input terminals by "−1", and the result data of the adder 163 is subsequently reduced one after another to approach the last value of "126".

The equation for the waveform calculation for the decay period is expressed as $$A_n = A_{n-1} - \frac{A_{n-1} - SUS}{256} \quad (4)$$

where SUS=126. FIG. 21 shows the results of calculations according to the equation (2) (i.e., envelope output) for every 10 steps. It will be seen that the level during the decay period is progressively reduced from the maximum level of "255" down to the preset sustain level of "126".

When the envelope output becomes the same value of "126" as the sustain level, the result data of the adder 163, i.e., the envelope output, is fixed to "126", whereupon the sustain period of the third channel sets in. This sustain period is continued until the relevant key is released.

When the key is released, a key-off pulse (of "1") is sent out from the keyboard 12. With this key-off pulse (of "1") the output of the AND gate 107 is changed to "1", which is coupled through the OR gate 98 to the first bit of the first stage register of the shift register 92. At the same time, the aforementioned "1" output is coupled through the OR gates 99 and 100 and AND gates 101 and 102 to the second bit of the first stage register mentioned above. As a result, the content of the third channel is changed to "3" indicative of the release period. When this content "3" is supplied to the decoder 94, a signal of "1" is provided only from the output terminal "3" of the decoder 94 at the timing for the third channel. With this "1" signal, the switching gate group 168 is enabled at the timing for the third channel. The content "3" of the third channel in the shift register 92 is subsequently held circulated.

When the release period of the third channel is brought about after the release of the key in the manner as described above, from the switching gate group 186 data of all bits "0" is supplied to the inverter group 172 at every timing of the third channel. Thus, the adder 171 provides the data coupled to the A input terminals (i.e., data less than the sustain level of "126") from its S output terminals while also providing a carry signal (of "1") from the carry output terminal $C_{out}$ at every timing for the third channel. The operation of the compensating circuit 173 during the sustain period is entirely the same as that during the decay period as described above. Thus, the rounding of the result data of the adder 171 (i.e., envelope data) is effected depending upon whether a signal of "1" is coupled to the carry input terminal $C_{in}$ until the upper six bits of the result data of the adder 163 all become "1". Also, when the upper six bits of the result data of the adder 171 all become "0", what is obtained by incrementing the data input to the C input terminals by "−1" is provided. Thus, during the release period, waveform calculations according to an equation $$A_n = A_{n-1} - \frac{A_{n-1} - 0}{256} \quad (5)$$

are executed.

FIG. 22 shows the results of calculations according to the equation (5) (i.e., envelope output) for every 10 steps. It will be understood that the output level is progressively reduced from the sustain level of "126" down to the last level of "0" after the start of the release period.

When the result data of the adder 171 becomes "0" (all bits becoming "0"), the signal all "0" is changed from "0" to "1" and impressed upon the AND gate 118. As a result, the output of the AND gate 118 is changed to "1", which is inverted by the inverter 134 to "0" for disabling the AND gates 96 and 101 at the same time. Thus, the content of the register for the third channel in the shift register is rendered to be "0", that is, the channel having been assigned to that register is rendered to be a vacant channel. In consequence, and also since the envelope output is reduced to "0", the musical sound for the relevant key completely vanishes.

Figure 23A:
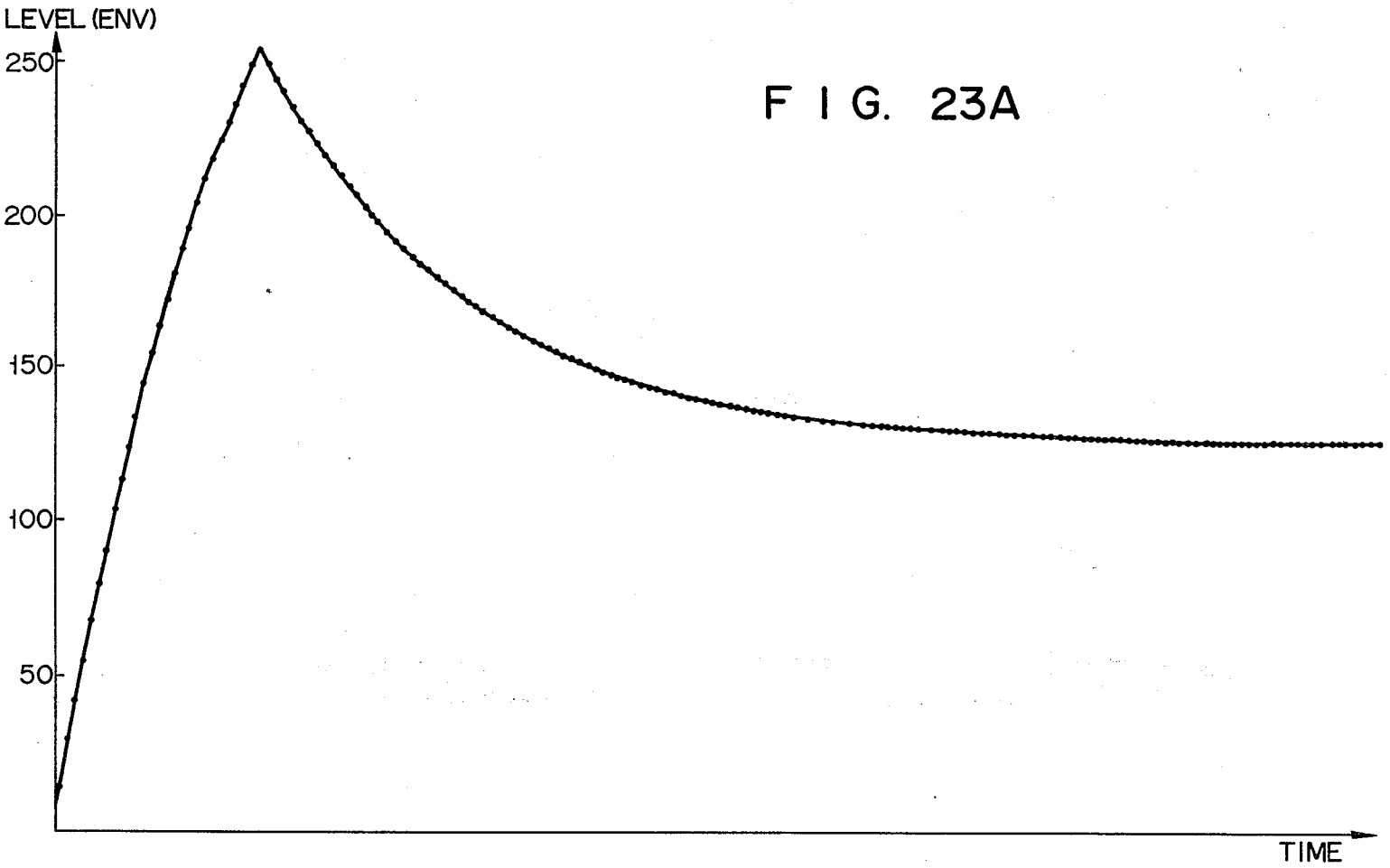
FIGS. 23A and 23B are waveform diagrams showing an output envelope from the generator shown in FIGS. 19A and 19B.
Figure 23B:
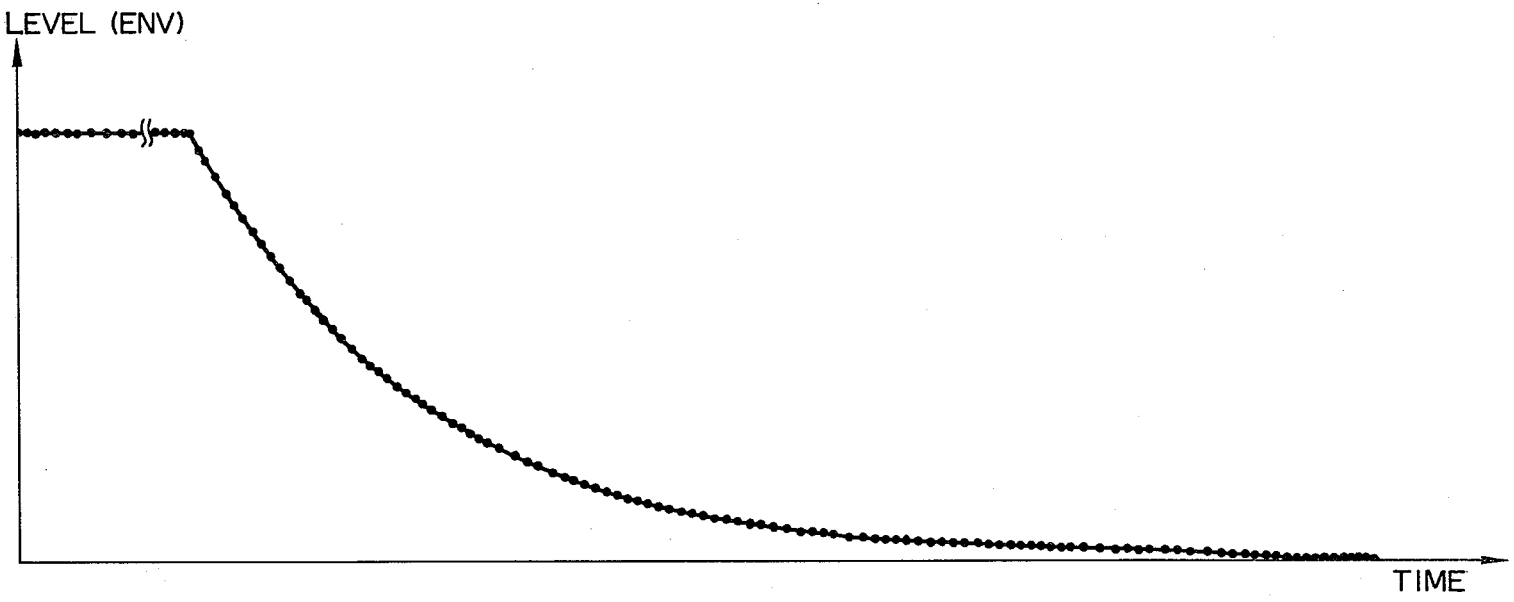

In the above way, the waveform calculation with respect to the third channel is completed. FIGS. 23A and 23B show envelope waveform diagrams representing the envelope output (or amplitude level) for the attack, decay, sustain and release periods plotted for every 10 steps.

In the preceding embodiment, if the key is released during the attack period of the envelope, the output of the AND gate 107 is changed to "1", whereupon the third channel content of the envelope status counter 91 is immediately changed from "1" indicating the attack period to "3" to start the release period. As a result, the adder 171 and other circuits commence calculation for the release period with respect to the envelope output value at the key-off instant. Further, when the key is released during the decay period, the third channel content of the envelope status counter 91 is changed from "2" to "3", and thus the release status sets in before the reaching of the sustain level.

With the ADSR envelope generator of the preceding embodiment, when the sustain level is changed during the decay or sustain period, the value of the data supplied to the B input terminals of the adder 171 is changed from that instant, that is, the previous value is changed to the newly set value gradually in the form of an exponential function (i.e., entirely in the same way as would be obtained if the envelope generator were constructed using the prior art analog circuit).

While in the above embodiment calculation in the ADSR envelope generator has been executed according to the equation (2) mentioned above, the terms $\alpha$ and $\gamma$ in this equation may of course be changed to various values if necessary.

Further, when the invention is applied to music synthesizers, it permits control of the oscillation frequency, cut-off frequency of filter, sound volume envelope, etc. Further, it is possible to obtain various envelope controls for a variety of electronic musical instruments.

What is claimed is:

1. An envelope control device for an electronic keyboard musical instrument having performance keys comprising:

envelope information setting means for setting information representing the attack period, decay period, sustain level and release period of the envelope of a musical sound;

state memory means for setting and storing a current status of the envelope changing in the order of attack status, decay status, sustain status and release status from the time of depression of a performance key until the time of release of the performance key; and digital processing means including memory means for storing waveform data representing an exponential curve; and control means coupled to said envelope information setting means and to said state memory means, and including means for accessing said memory means for obtaining data for the attack, decay, and release status sections of the envelope for the operated performance key according to the depression and release thereof on the basis of preset information from said envelope information setting means while controlling the memory state of said state memory means.

2. The envelope control device of claim 1, wherein said envelope information setting means, said state memory means and said digital processing means are of a multichannel construction, and further comprising means for causing the operation of said multichannel construction means on a time division basis.

3. The envelope control device of claim 2, wherein said state memory means includes an envelope status counter for setting a status of the envelope according to the count content of said envelope status counter.

4. An envelope control device for an electronic keyboard musical instrument having performance keys, comprising:

envelope information setting means for setting information representing the attack period, decay period, sustain level and release period of the envelope of a musical sound;

state memory means for setting and storing a current status of the envelope changing in the order of attack status, decay status, sustain status and release status from the time of depression of a performance key until the time of release of the performance key; and digital processing means coupled to said envelope information setting means and to said state memory means, and including:

calculation circuit means for calculating the waveform data at the time of attack, decay and release on the basis of an equation $$A_n = A_{(n-1)} - \frac{A_{(n-1)}}{\alpha}$$

where n is an integer and $\alpha$ is a positive number; and an initial value supply means for supplying initial values to said calculation circuit means for the calculation of the waveform data;

whereby data for the attack, decay, sustain and release status sections of the envelope for the operated performance key is obtained according to the depression and release thereof on the basis of preset information from said envelope information setting means while controlling the memory state of said state memory means.

5. The envelope control device of claim 4, wherein said envelope information setting means, said state memory means and said digital processing means are of a multichannel construction; and further comprising means for causing the operation of said multichannel construction means on a time division basis.

6. The envelope control device of claim 5, wherein said state memory means includes an envelope status counter for setting a status of the envelope according to the count content of said envelope status counter.

7. An envelope control device for an electronic keyboard musical instrument having performance keys, comprising:

envelope information setting means for setting information representing the attack period, decay period, sustain level and release period of the envelope of a musical sound;

state memory means for setting and storing the current status of the envelope changing in the order of attack status, decay status, sustain status and release status from the time of depression of performance key until the time of release of the performance key; and digital processing means coupled to said envelope information setting means and to said state memory means, and including:

means for obtaining data for the attack, decay, sustain and release status sections of the envelope for the operated performance key according to the depression and release thereof on the basis of the preset information from said envelope information setting means while controlling the memory state of said state memory means; and means for setting maximum data as a final level of the attack status, said maximum data being unchanged in accordance with the information from said envelope information setting means.

8. The envelope control device of claim 7, wherein said envelope information setting means, said state memory means and said digital processing means are of a multichannel construction; and further comprising means for causing the operation of said multichannel construction means on a time division basis.

9. The envelope control according to claim 8, wherein said state memory means includes an envelope status counter for setting a status of the envelope according to the count content of said envelope status counter.

10. An envelope control device for an electronic keyboard musical instrument having performance keys, comprising:

envelope information setting eans for setting information representing the attack period, decay period, sustain level and release period of the envelope of a musical sound;

state memory means for setting and storing a current status of the envelope changing in the order of attack status, decay status, sustain status and release status from the time of depression of a performance key until the time of release of the performance key; and digital processing means coupled to said envelope information setting means and to said state memory means, and including:

calculation circuit means for calculating the waveform data at the time of attack, decay and release on the basis of an equation $$A_n = A_{(n-1)} - \frac{A_{(n-1)} - \gamma}{\alpha}$$

where n is an integer, $\alpha$ is a positive number and $\gamma$ is a positive variable number which varies according to the envelope state, and wherein $\gamma$ is set to a predetermined value which is greater than the value of $\alpha$ during the attack period; and an initial value supplying means for supplying initial values to said calculation circuit means for the calculation of the waveform data;

whereby data for the attack, decay, sustain and release status sections of the envelope for the operated performance key is obtained according to the depression and release thereof on the basis of preset information from said envelope information setting means while controlling the memory state of said state memory means.

11. The envelope control device of claim 10, wherein said positive number $\gamma$ is set to a sustain level during the decay and sustain periods and to zero during the release period.

12. The envelope control device of claim 10, wherein:

said digital processing means includes variable clock generating means for generating a clock signal, the period of the clock signal being variable; and said calculation circuit means is driven under the control of said variable period clock signal.

13. The envelope control device of claim 10, wherein said envelope information setting means, said state memory means and said digital processing means are of a multichannel construction; and further comprising means for causing the operation of said multichannel construction means on a time division basis.

14. The envelope control device of claim 11, wherein said state memory means includes an envelope status counter for setting a status of the envelope according to the count content of said envelope status counter.

* * * * *